US010820119B2

(12) United States Patent
Petersen et al.

(10) Patent No.: US 10,820,119 B2
(45) Date of Patent: Oct. 27, 2020

(54) HEARING DEVICE COMPRISING A FEEDBACK REDUCTION SYSTEM

(71) Applicant: Oticon A/S, Smørum (DK)

(72) Inventors: Svend Oscar Petersen, Smørum (DK); Michael Syskind Pedersen, Smørum (DK); Karsten Bo Rasmussen, Smørum (DK)

(73) Assignee: OTICON A/S, Smørum (DK)

( * ) Notice: Subject to any disclaimer, the term of this patent is extended or adjusted under 35 U.S.C. 154(b) by 0 days.

(21) Appl. No.: 16/449,729

(22) Filed: Jun. 24, 2019

(65) Prior Publication Data

US 2019/0394576 A1 Dec. 26, 2019

(30) Foreign Application Priority Data

Jun. 25, 2018 (EP) ..... 18179465

(51) Int. Cl.
*H04R 25/00* (2006.01)

(52) U.S. Cl.
CPC ..... *H04R 25/407* (2013.01); *H04R 25/356* (2013.01); *H04R 25/405* (2013.01); *H04R 25/453* (2013.01); *H04R 25/505* (2013.01); *H04R 2225/021* (2013.01); *H04R 2225/025* (2013.01); *H04R 2225/67* (2013.01)

(58) Field of Classification Search
CPC .. H04R 25/405; H04R 25/407; H04R 25/453; H04R 25/505; H04R 2225/021; H04R 2225/025; H04R 2460/01; H04R 25/356; H04R 2225/67
USPC ..... 381/313, 318, 83, 93, 94.1
See application file for complete search history.

(56) References Cited

U.S. PATENT DOCUMENTS 5,259,033 A * 11/1993 Goodings ..... H03H 21/0012 381/318
8,019,104 B2 * 9/2011 Klinkby ..... H04R 25/453 381/317
2017/0180878 A1 * 6/2017 Petersen ..... H04R 25/305

FOREIGN PATENT DOCUMENTS

EP 3185588 A1 6/2017
EP 3185589 A1 6/2017
EP 3267697 A1 1/2018
WO WO 2007/113282 A1 10/2007

* cited by examiner

*Primary Examiner* — Huyen D Le
(74) *Attorney, Agent, or Firm* — Brich, Stewart, Kolasch & Birch, LLP

(57) ABSTRACT

A hearing device, e.g. a hearing aid, comprises a) an input unit comprising a multitude of input transducers for providing respective electric input signals representing sound in an environment of the user; b) an output unit comprising an output transducer for providing stimuli perceivable to the user as sound based on said electric input signals or a processed version thereof; c) a spatial filter connected to said input unit and to said output unit, and configured to provide a spatially filtered signal based on said multitude of electric input signals and configurable beamformer weights; d) a spatial filter controller configured to apply first and/or second different sets of beamformer weights to said multitude of electric input signals, wherein said first set of beamformer weights is applied to provide spatial filtering of sound from said output transducer, and wherein said second set of beamformer weights is applied to provide spatial filtering of an external sound field. A method of operating a hearing device is further disclosed.

21 Claims, 9 Drawing Sheets

HEARING DEVICE COMPRISING A FEEDBACK REDUCTION SYSTEM

SUMMARY

In state of the art hearing aids, the acoustical gain is limited by the acoustical feedback that can make the hearing instrument oscillate, if the loop gain is higher than 0 dB. For most hearing aid styles, the feedback level depends on the degree of opening (e.g. size of a vent in an ear mould) of a part of the hearing aid located in the ear canal of the user, and further on the distance between the opening and the microphone(s) of the hearing aid. For in the ear (ITE) type hearing aids, where the microphones are placed in the ear canal or in concha of the ear, the distance between the vent and the microphone is very small compared to behind the ear (BTE) type or receiver in the ear (RITE) style hearing instruments (HI), where the microphones are typically placed farther away from the loudspeaker (receiver), e.g. behind the ear. So for an ITE style HI, the feedback is usually a bigger problem than for a BTE/RITE style HI.

A Hearing Device:

In an aspect of the present application, a hearing device, e.g. a hearing aid, configured to be located at or in an ear of a user is provided. The hearing device comprises

- an input unit comprising a multitude of input transducers for providing respective electric input signals representing sound in an environment of the user;
- an output unit comprising an output transducer for providing stimuli perceivable to the user as sound based on said electric input signals or a processed version thereof;
- a (configurable) spatial filter connected to said input unit and to said output unit, and configured to provide a spatially filtered signal based on said multitude of electric input signals and configurable beamformer weights.

The hearing device further comprises

- a spatial filter controller configured to apply first and/or second different sets of beamformer weights to said multitude of electric input signals (or signals derived therefrom).

The first set of beamformer weights is applied to provide spatial filtering of sound from the output transducer, and the second set of beamformer weights is applied to provide spatial filtering of an external sound field (external meaning in the environment away from the user).

Thereby an improved hearing device may be provided.

The hearing device comprises or is constituted by a part adapted for being located fully or partially at or in a user's ear canal, termed the ITE-part. The ITE-part may comprise a standard housing or a housing customized to a particular user's ear. The housing of the ITE-part may enclose or mechanically support some or all of the components of the hearing device. The housing of the ITE part may comprise an ear mould, e.g. a customized ear mould. The ITE part, e.g. the housing of the ITE part, may comprise (or provide when mounted) an acoustic ventilation channel (termed 'a vent'), possibly two or more (e.g. distributed) ventilation channels, e.g. to diminish the occlusion effect. The ventilation channel(s) is(are) configured to equalize pressure differences between the environment and a residual volume between the housing of the ITE part and the ear drum (when the ITE part is operationally mounted). Thereby occlusion can be reduced. The vent may be formed in many different ways, e.g. with a view to reducing occlusion, while minimizing leakage of sound to the environment.

The hearing device may contain two input transducers. In an embodiment, the hearing device contains only to input transducers. The two input transducers may be located in the ITE-part, e.g. together with the output transducer.

The input unit is configured to be located in a user's ear, e.g. in an ear canal or in or close to concha (to thereby benefit from the frequency shaping of an acoustic signal by pinna). In an embodiment, the ITE part comprises the input unit. Hence, the multitude of input transducers may be located in the ITE part. In an embodiment, the ITE part comprises at least one of the multitude of input transducers, such as at least two, e.g. all of said multitude of input transducers. In an embodiment, the input unit contains two or three input transducers, e.g. microphones.

The output transducer may be located in the ITE part. The output transducer may be located in a BTE part adapted for being located at or behind an ear (pinna) of the user. The output transducer may be located at or on a sidebar or a spectacle frame.

The first set of (generally complex) beamformer weights is configured to decrease the amount of sound from the output transducer that reaches the input transducers (i.e. to minimize acoustic feedback). The second set of (generally complex) beamformer weights is e.g. configured to maintain sound from a target direction to a sound source, e.g. in the acoustic far-field, while attenuating sound from other directions (or to attenuate sound from the target direction less than sound from other directions). In an embodiment, the spatial filter controller is configured to apply a combination of the first and second sets of beamformer weights. This may be of interest to provide fading between the two sets of weights to avoid abrupt changes of the beamformer weights from one set to the other (e.g. switching between the first and second sets of beamformer weights), which are likely to become audible. In an embodiment, the first as well as the second set of beamformer weights are configured to maintain sound from a target direction unaltered (e.g. a direction to a target sound source in the acoustic far-field).

The first and second sets of beamformer weights may take on complex values. One or more (such as all) of the first and second sets of beamformer weights may take on real values.

The first and second sets of beamformer weights may be applied at different times. In an embodiment, only one of said first and second sets of beamformer weights are applied at a given time, in a given frequency band. In other words, in an embodiment, only one of the first and second sets of beamformer weights are active at a given time (in a given frequency band). This is e.g. necessary in solutions where only electric input signals from two independent input transducers are available for beamforming (but may also be practical in solutions comprising more than two, e.g. three or four, input transducers, e.g. microphones).

It may however be advantageous to gradually change from one set of beamformer weights to another (fade). The spatial filter controller may be configured to gradually change from one set of beamformer weights to another (e.g. from the first to the second or from the second to the first set of beamformer weights).

It may further be advantageous to apply both sets of beamformer weights at the same time. This requires, however, that electric input signals from three or more independent input transducers are available for beamforming. In an embodiment, the first and the second sets of beamformer weights are applied at the same time at least in one frequency band (e.g. in all frequency bands).

The input unit may comprise respective filter banks configured to provide said electric input signals in a time-frequency representation (k,m), e.g. as digitized frequency sub-band signals, where k and m are frequency and time indices, respectively.

The hearing device may be configured to provide that said first and second sets of beamformer weights are frequency dependent. In an embodiment, the first set of beamformer weights are applied in one frequency band, and a second set of beamformer weights are applied in another frequency band. In other words, at a given point in time, beamformer weights from the first set of beamformer weights may be applied in some frequency bands, while beamformer weights from the second set of beamformer weights may be applied in other (e.g. complementary, e.g. all other) frequency bands.

The hearing device may be configured to provide that the first and/or the second set of beamformer weights is/are adaptively determined. In an embodiment, the hearing device is configured to provide that the first set of beamformer weights is adaptive to feedback changes. In an embodiment, the hearing device is configured to provide that the second set of beamformer weights is adaptive to noise. In an embodiment the first and second set of beamformer weights are adaptive. In an embodiment, the hearing device is configured to provide that the target direction is adaptively determined (this topic is e.g. dealt with in our co-pending patent application EP3267697A1).

The hearing device may be configured to provide that said first set of beamformer weights is only applied in selected frequency bands. In an embodiment, first set of beamformer weights is only applied in pre-selected frequency bands (e.g. in frequency bands where feedback is expected to occur, e.g. determined by the hearing aid style, and/or determined during fitting, or adaptively determined during use, e.g. by a feedback estimator that estimates a current risk of feedback on a frequency sub-band level).

The hearing device may comprise a feedback estimator configured to provide an estimate of a current level of feedback from said output transducer to at least one of said input transducers. The feedback estimator may be configured to provide an estimate of a current level of feedback from said output transducer to at least one (such as all) of said input transducers in one or more (such as all) frequency bands, e.g. such frequency bands that are particularly prone to experiencing feedback, e.g. one or more frequency bands between 1 kHz and 8 kHz, such as between 1.5 kHz and 4 kHz.

The feedback estimator may be configured to provide a feedback estimate of a current feedback path from said output transducer to at least two of, such as all of, said input transducers. The estimate of the feedback path may be provided as a frequency transfer function from the output transducer to a given input transducer (e.g. specified at a number of different frequencies). The estimate of the feedback path may be provided as an impulse response from the output transducer to a given input transducer.

In an embodiment, the hearing device is configured to adaptively determine (or select) the appropriate set of beamformer weights in dependence of the input level (e.g. the level(s) of an electric input signal (or signals) from an input transducer(s)). The spatial filter controller may be configured to adaptively select the appropriate (e.g. predetermined) set of beamformer weights (e.g. among two or more sets of beamformer weights stored in a memory) in dependence of the input level of one or more of the multitude of input transducers. The spatial filter controller may be configured to adaptively select between two or more sets of beamformer weights (including the first and second sets of beamformer weights).

The hearing device may be configured to determine (or select) the appropriate set of beamformer weights in dependence of, such as only in dependence of, the input level (e.g. the level(s) of an electric input signal (or signals) from an input transducer(s)) without inputs from a feedback estimator. The hearing device may be configured to determine (or select) the appropriate set of beamformer weights in dependence of a mode of operation of the hearing device, e.g. a communication mode (such as a telephone mode), or a feedback-risk mode, or a normal (multi-environment) mode, etc.

The hearing device may comprise at least one level estimator for estimating an input level of at least one of the electric input signals, wherein the spatial filter controller is configured to apply the first and/or second different sets of beamformer weights to the multitude of electric input signals in dependence of the estimated input level(s). In an embodiment, the hearing device comprises respective level estimators configured to provide a level estimate of a current input signal for at least two of, such as each of, said multitude of electric input signals. The hearing device may alternatively or additionally, comprise a level estimator for estimating a current level of said spatially filtered signal. The hearing device may comprise at least one level estimator for estimating an input level of at least one of said electric input signals, wherein the spatial filter controller is configured to apply the second set of beamformer weights to said multitude of electric input signals when the input level of said at least one electric input signal is higher than an input threshold level. In an embodiment, the input threshold level is equal to 60 dB or more, such as 70 dB or more. In an embodiment, the spatial filter controller is configured to deactivate the first set of beamformer weights when the input level of said at least one electric input signal is higher than the input threshold level. In an embodiment, the spatial filter controller is configured to activate the first set of beamformer weights when the input level of said at least one electric input signal is lower than the input threshold level. In an embodiment, the spatial filter controller is configured to deactivate the second set of beamformer weights when the input level of said at least one electric input signal is lower than the input threshold level.

The input threshold level may be different for at least some of the multitude of electric input signals from respective multitude of input transducers (e.g. microphones). The input threshold level for a given input transducer may be dependent on the location of the input transducer in the hearing device (e.g. dependent on a location relative to the output transducer; e.g. dependent on a distance and/or an acoustic impedance of the path from the output transducer to the input transducer). In an embodiment, a set of input level thresholds for each frequency band of each input transducer is defined (and accessible to the spatial filter controller, e.g. stored in a memory of the hearing device).

The hearing device may comprise a loop gain estimator for estimating a current loop magnitude of a feedback loop defined by a forward path between the input unit and the output unit, and an external feedback path from said output unit to said input unit, and the spatial filter controller is configured to apply said first and/or second different sets of beamformer weights to said multitude of electric input signals in dependence of said estimated current loop magnitude. The hearing device may comprise a loop gain estimator for estimating a current loop magnitude of a feedback loop defined by a forward path between the input unit and the output unit, and an external feedback path from said output unit to said input unit. The spatial filter controller may be configured to deactivate the first set of beamformer weights when the current loop magnitude is below loop magnitude threshold. In an embodiment, the loop magnitude threshold is equal to or lower than 0 dB.

The hearing device may e.g. comprise a compressor for applying a compressive amplification algorithm to a signal of the forward path of the hearing device. The compressor is configured to apply a compressive amplification in dependence of a level estimate of an electric input signal (e.g. from a microphone) or based on a beamformed signal. The compressor may be configured to compensate for a hearing impairment of a user of the hearing device. The requested gain of the compressor at a given point in time and at a given frequency is thus dependent on the hearing threshold (and the uncomfortable level) of the user (at that frequency), the level of the input signal (at that frequency) and possibly of the hearing aid style in question.

The hearing device may comprise a compressor providing a current requested gain to be applied to one of said electric input signals or to a weighted combination of said electric input signals in dependence of A) a level estimate of the electric input signal in question and B) of a user's needs, wherein the spatial filter controller is configured to apply said first and/or second different sets of beamformer weights to said multitude of electric input signals in dependence of said current requested gain. The spatial filter controller may be configured to apply the first set of beamformer weights to said multitude of electric input signals when the current requested gain is higher than a threshold gain. Appropriate (e.g. frequency dependent, e.g. predetermined or adaptively determined) threshold gains may be stored in a memory of (or may be otherwise accessible to) the hearing device.

In an embodiment, the hearing device is configured to adaptively determine (or select) the appropriate set of beamformer weights in dependence of a current requested gain provide by a compressor of the hearing device. The spatial filter controller may be configured to adaptively select the appropriate (e.g. predetermined) set of beamformer weights (e.g. among two or more sets of beamformer weights stored in a memory) in dependence of the requested gain from the compressor. The spatial filter controller may be configured to adaptively select between two or more sets of beamformer weights (including the first and second sets of beamformer weights), cf. e.g. FIG. 3.

The hearing device may comprise a level detector configured to provide an estimate of background noise level at a given point time. In situations, where the input level from the external sound field is relatively high (e.g. >70 dB SPL) and where the background noise is relatively high, spatial filtering of the external sound field can be activated, and at these high input levels the compression will lower the gain, and the spatial anti-feedback system can be deactivated. The spatial filter controller may be configured to activate the second set of beamformer weights to said multitude of electric input signals when the current background noise level is higher than a noise threshold level and the input level is higher than an input threshold level. Appropriate (e.g. frequency dependent, e.g. predetermined or adaptively determined) noise threshold levels may be stored in a memory of (or may be otherwise accessible to) the hearing device, e.g. together with corresponding values of the input threshold level (e.g. for each input transducer).

The hearing device may be constituted by or comprise a hearing aid, a headset, an earphone, an ear protection device or a combination thereof.

In an embodiment, the hearing device is adapted to provide a frequency dependent gain and/or a level dependent compression and/or a transposition (with or without frequency compression) of one or more frequency ranges to one or more other frequency ranges, e.g. to compensate for a hearing impairment of a user. In an embodiment, the hearing device comprises a signal processor for enhancing the input signals and providing a processed output signal.

The hearing device comprises an output unit for providing a stimulus perceived by the user as an acoustic signal based on a processed electric signal. In an embodiment, the output unit comprises an output transducer. In an embodiment, the output transducer comprises a receiver (loudspeaker) for providing the stimulus as an acoustic signal to the user. In an embodiment, the output transducer comprises a vibrator for providing the stimulus as mechanical vibration of a skull bone to the user (e.g. in a bone-attached or bone-anchored hearing device).

The hearing device comprises an input unit for providing an electric input signal representing sound. In an embodiment, the input unit comprises an input transducer, e.g. a microphone, for converting an input sound to an electric input signal. In an embodiment, the input unit comprises a wireless receiver for receiving a wireless signal comprising sound and for providing an electric input signal representing said sound.

The hearing device comprises a directional microphone system adapted to spatially filter sounds from the environment, and thereby enhance a target acoustic source among a multitude of acoustic sources in the local environment of the user wearing the hearing device. In an embodiment, the directional system is adapted to detect (such as adaptively detect) from which direction a particular part of the microphone signal originates. This can be achieved in various different ways as e.g. described in the prior art. In hearing devices, a microphone array beamformer is often used for spatially attenuating background noise sources. Many beamformer variants can be found in literature. The minimum variance distortionless response (MVDR) beamformer is widely used in microphone array signal processing. Ideally the MVDR beamformer keeps the signals from the target direction (also referred to as the look direction) unchanged, while attenuating sound signals from other directions maximally. The generalized sidelobe canceller (GSC) structure is an equivalent representation of the MVDR beamformer offering computational and numerical advantages over a direct implementation in its original form.

In an embodiment, the hearing device comprises an antenna and transceiver circuitry (e.g. a wireless receiver) for wirelessly receiving a direct electric input signal from another device, e.g. from an entertainment device (e.g. a TV-set), a communication device, a wireless microphone, or another hearing device. In an embodiment, the direct electric input signal represents or comprises an audio signal and/or a control signal and/or an information signal.

In an embodiment, the communication between the hearing device and the other device is in the base band (audio frequency range, e.g. between 0 and 20 kHz). Preferably, communication between the hearing device and the other device is based on some sort of modulation at frequencies above 100 kHz. Preferably, frequencies used to establish a communication link between the hearing device and the other device is below 70 GHz, e.g. located in a range from 50 MHz to 70 GHz, e.g. above 300 MHz, e.g. in an ISM range above 300 MHz, e.g. in the 900 MHz range or in the 2.4 GHz range or in the 5.8 GHz range or in the 60 GHz range (ISM=Industrial, Scientific and Medical, such standardized ranges being e.g. defined by the International Telecommunication Union, ITU). In an embodiment, the wireless link is based on a standardized or proprietary technology. In an embodiment, the wireless link is based on Bluetooth technology (e.g. Bluetooth Low-Energy technology).

In an embodiment, the hearing device is a portable device, e.g. a device comprising a local energy source, e.g. a battery, e.g. a rechargeable battery.

In an embodiment, the hearing device comprises a forward or signal path between an input unit (e.g. an input transducer, such as a microphone or a microphone system and/or direct electric input (e.g. a wireless receiver)) and an output unit, e.g. an output transducer. In an embodiment, the signal processor is located in the forward path. In an embodiment, the signal processor is adapted to provide a frequency dependent gain according to a user's particular needs. In an embodiment, the hearing device comprises an analysis path comprising functional components for analyzing the input signal (e.g. determining a level, a modulation, a type of signal, an acoustic feedback estimate, etc.). In an embodiment, some or all signal processing of the analysis path and/or the signal path is conducted in the frequency domain. In an embodiment, some or all signal processing of the analysis path and/or the signal path is conducted in the time domain.

In an embodiment, an analogue electric signal representing an acoustic signal is converted to a digital audio signal in an analogue-to-digital (AD) conversion process, where the analogue signal is sampled with a predefined sampling frequency or rate $f_s$, $f_s$ being e.g. in the range from 8 kHz to 48 kHz (adapted to the particular needs of the application) to provide digital samples $x_n$ (or x[n]) at discrete points in time $t_n$ (or n), each audio sample representing the value of the acoustic signal at $t_n$ by a predefined number $N_b$ of bits, $N_b$ being e.g. in the range from 1 to 48 bits, e.g. 24 bits. Each audio sample is hence quantized using $N_b$ bits (resulting in $2^{Nb}$ different possible values of the audio sample). A digital sample x has a length in time of $1/f_s$, e.g. 50 μs, for $f_s$=20 kHz. In an embodiment, a number of audio samples are arranged in a time frame. In an embodiment, a time frame comprises 64 or 128 audio data samples. Other frame lengths may be used depending on the practical application.

In an embodiment, the hearing devices comprise an analogue-to-digital (AD) converter to digitize an analogue input (e.g. from an input transducer, such as a microphone) with a predefined sampling rate, e.g. 20 kHz. In an embodiment, the hearing devices comprise a digital-to-analogue (DA) converter to convert a digital signal to an analogue output signal, e.g. for being presented to a user via an output transducer.

In an embodiment, the hearing device, e.g. the microphone unit, and or the transceiver unit comprise(s) a TF-conversion unit for providing a time-frequency representation of an input signal. In an embodiment, the time-frequency representation comprises an array or map of corresponding complex or real values of the signal in question in a particular time and frequency range. In an embodiment, the TF conversion unit comprises a filter bank for filtering a (time varying) input signal and providing a number of (time varying) output signals each comprising a distinct frequency range of the input signal. In an embodiment, the TF conversion unit comprises a Fourier transformation unit for converting a time variant input signal to a (time variant) signal in the (time-)frequency domain. In an embodiment, the frequency range considered by the hearing device from a minimum frequency $f_{min}$ to a maximum frequency $f_{max}$ comprises a part of the typical human audible frequency range from 20 Hz to 20 kHz, e.g. a part of the range from 20 Hz to 12 kHz. Typically, a sample rate $f_s$ is larger than or equal to twice the maximum frequency $f_{max}$, $f_s \geq 2f_{max}$. In an embodiment, a signal of the forward and/or analysis path of the hearing device is split into a number NI of frequency bands (e.g. of uniform width), where NI is e.g. larger than 5, such as larger than 10, such as larger than 50, such as larger than 100, such as larger than 500, at least some of which are processed individually. In an embodiment, the hearing device is/are adapted to process a signal of the forward and/or analysis path in a number NP of different frequency channels (NP≤NI). The frequency channels may be uniform or non-uniform in width (e.g. increasing in width with frequency), overlapping or non-overlapping.

In an embodiment, the hearing device comprises a number of detectors configured to provide status signals relating to a current physical environment of the hearing device (e.g. the current acoustic environment), and/or to a current state of the user wearing the hearing device, and/or to a current state or mode of operation of the hearing device. Alternatively or additionally, one or more detectors may form part of an external device in communication (e.g. wirelessly) with the hearing device. An external device may e.g. comprise another hearing device, a remote control, and audio delivery device, a telephone (e.g. a smartphone), an external sensor, etc.

In an embodiment, one or more of the number of detectors operate(s) on the full band signal (time domain). In an embodiment, one or more of the number of detectors operate(s) on band split signals ((time-) frequency domain), e.g. in a limited number of frequency bands.

In an embodiment, the number of detectors comprises a level detector for estimating a current level of a signal of the forward path. In an embodiment, the predefined criterion comprises whether the current level of a signal of the forward path is above or below a given (L-)threshold value. In an embodiment, the level detector operates on the full band signal (time domain). In an embodiment, the level detector operates on band split signals ((time-) frequency domain).

In a particular embodiment, the hearing device comprises a voice detector (VD) for estimating whether or not (or with what probability) an input signal comprises a voice signal (at a given point in time). A voice signal is in the present context taken to include a speech signal from a human being. It may also include other forms of utterances generated by the human speech system (e.g. singing). In an embodiment, the voice detector unit is adapted to classify a current acoustic environment of the user as a VOICE or NO-VOICE environment.

This has the advantage that time segments of the electric microphone signal comprising human utterances (e.g. speech) in the user's environment can be identified, and thus separated from time segments only (or mainly) comprising other sound sources (e.g. artificially generated noise). In an embodiment, the voice detector is adapted to detect as a VOICE also the user's own voice. Alternatively, the voice detector is adapted to exclude a user's own voice from the detection of a VOICE.

In an embodiment, the hearing device comprises an own voice detector for estimating whether or not (or with what probability) a given input sound (e.g. a voice, e.g. speech) originates from the voice of the user of the system. In an embodiment, a microphone system of the hearing device is adapted to be able to differentiate between a user's own voice and another person's voice and possibly from NON-voice sounds.

In an embodiment, the number of detectors comprises a movement detector, e.g. an acceleration sensor, e.g. an accelerometer, and/or a gyroscope. In an embodiment, the movement detector is configured to detect movement and/or orientation of the user, or the user's head (e.g. including the hearing device) and to provide a detector signal indicative thereof.

In an embodiment, the hearing device comprises a classification unit configured to classify the current situation based on input signals from (at least some of) the detectors, and possibly other inputs as well. In the present context, 'a current situation' is taken to be defined by one or more of a) the physical environment (e.g. including the current electromagnetic environment, e.g. the occurrence of electromagnetic signals (e.g. comprising audio and/or control signals) intended or not intended for reception by the hearing device, or other properties of the current environment than acoustic);

b) the current acoustic situation (input level, feedback, etc.), and c) the current mode or state of the user (movement, temperature, cognitive load, etc.);

d) the current mode or state of the hearing device (program selected, time elapsed since last user interaction, etc.) and/or of another device in communication with the hearing device.

In an embodiment, the hearing device comprises an acoustic (and/or mechanical) feedback suppression system. Acoustic feedback occurs because the output loudspeaker signal from an audio system providing amplification of a signal picked up by a microphone is partly returned to the microphone via an acoustic coupling through the air or other media. The part of the loudspeaker signal returned to the microphone is then re-amplified by the system before it is re-presented at the loudspeaker, and again returned to the microphone. As this cycle continues, the effect of acoustic feedback becomes audible as artifacts or even worse, howling, when the system becomes unstable. The problem appears typically when the microphone and the loudspeaker are placed closely together, as e.g. in hearing aids or other audio systems. Some other classic situations with feedback problem are telephony, public address systems, headsets, audio conference systems, etc. Adaptive feedback cancellation has the ability to track feedback path changes over time. It is based on a linear time invariant filter to estimate the feedback path but its filter weights are updated over time. The filter update may be calculated using stochastic gradient algorithms, including some form of the Least Mean Square (LMS) or the Normalized LMS (NLMS) algorithms. They both have the property to minimize the error signal in the mean square sense with the NLMS additionally normalizing the filter update with respect to the squared Euclidean norm of some reference signal.

In an embodiment, the feedback suppression system comprises a feedback estimator for providing a feedback signal representative of an estimate of the acoustic feedback path, and a combination unit, e.g. a subtraction unit, for subtracting the feedback signal from a signal of the forward path (e.g. as picked up by an input transducer of the hearing device).

In an embodiment, the hearing device further comprises other relevant functionality for the application in question, e.g. compression, noise reduction, etc.

In an embodiment, the hearing device comprises a listening device, e.g. a hearing aid, e.g. a hearing instrument, e.g. a hearing instrument adapted for being located at the ear or fully or partially in the ear canal of a user, e.g. a headset, an earphone, an ear protection device or a combination thereof. In an embodiment, the hearing assistance system comprises a speakerphone (comprising a number of input transducers and a number of output transducers, e.g. for use in an audio conference situation), e.g. comprising a spatial filter, e.g. providing multiple beamforming capabilities.

Use:

In an aspect, use of a hearing device as described above, in the 'detailed description of embodiments' and in the claims, is moreover provided. In an embodiment, use is provided in a system comprising audio distribution, e.g. a system comprising a microphone and a loudspeaker in sufficiently close proximity of each other to cause feedback from the loudspeaker to the microphone during operation by a user. In an embodiment, use is provided in a system comprising one or more hearing aids (e.g. hearing instruments), headsets, ear phones, active ear protection systems, etc., e.g. in handsfree telephone systems, teleconferencing systems (e.g. including a speakerphone), public address systems, karaoke systems, classroom amplification systems, etc.

A Method:

In an aspect, a method of operating a hearing device, e.g. a hearing aid, configured to be located at or in an ear of a user is furthermore provided by the present application. The method comprises providing a multitude of electric input signals representing sound in an environment of the user;

providing stimuli perceivable to the user as sound based on said electric input signals or a processed version thereof;

providing a spatially filtered signal based on said multitude of electric input signals and configurable beamformer weights.

The method further comprises applying first and/or second different sets of beamformer weights to said multitude of electric input signals, wherein said first set of beamformer weights is configured to provide spatial filtering of sound from said output transducer, and wherein said second set of beamformer weights is configured to provide spatial filtering of an external sound field.

It is intended that some or all of the structural features of the device described above, in the 'detailed description of embodiments' or in the claims can be combined with embodiments of the method, when appropriately substituted by a corresponding process and vice versa. Embodiments of the method have the same advantages as the corresponding devices.

A Computer Readable Medium:

In an aspect, a tangible computer-readable medium storing a computer program comprising program code means for causing a data processing system to perform at least some (such as a majority or all) of the steps of the method described above, in the 'detailed description of embodiments' and in the claims, when said computer program is executed on the data processing system is furthermore provided by the present application.

By way of example, and not limitation, such computer-readable media can comprise RAM, ROM, EEPROM, CD-ROM or other optical disk storage, magnetic disk storage or other magnetic storage devices, or any other medium that can be used to carry or store desired program code in the form of instructions or data structures and that can be accessed by a computer. Disk and disc, as used herein, includes compact disc (CD), laser disc, optical disc, digital versatile disc (DVD), floppy disk and Blu-ray disc where disks usually reproduce data magnetically, while discs reproduce data optically with lasers. Combinations of the above should also be included within the scope of computer-readable media. In addition to being stored on a tangible medium, the computer program can also be transmitted via a transmission medium such as a wired or wireless link or a network, e.g. the Internet, and loaded into a data processing system for being executed at a location different from that of the tangible medium.

A Computer Program:

A computer program (product) comprising instructions which, when the program is executed by a computer, cause the computer to carry out (steps of) the method described above, in the 'detailed description of embodiments' and in the claims is furthermore provided by the present application.

A Data Processing System:

In an aspect, a data processing system comprising a processor and program code means for causing the processor to perform at least some (such as a majority or all) of the steps of the method described above, in the 'detailed description of embodiments' and in the claims is furthermore provided by the present application.

A Hearing System:

In a further aspect, a hearing system comprising a hearing device as described above, in the 'detailed description of embodiments', and in the claims, AND an auxiliary device is moreover provided.

In an embodiment, the hearing system is adapted to establish a communication link between the hearing device and the auxiliary device to provide that information (e.g. control and status signals, possibly audio signals) can be exchanged or forwarded from one to the other.

In an embodiment, the hearing system comprises an auxiliary device, e.g. a remote control, a smartphone, or other portable or wearable electronic device, such as a smartwatch or the like.

In an embodiment, the auxiliary device is or comprises a remote control for controlling functionality and operation of the hearing device(s). In an embodiment, the function of a remote control is implemented in a smartphone, the smartphone possibly running an APP allowing to control the functionality of the audio processing device via the smartphone (the hearing device(s) comprising an appropriate wireless interface to the smartphone, e.g. based on Bluetooth or some other standardized or proprietary scheme).

In an embodiment, the auxiliary device is or comprises an audio gateway device adapted for receiving a multitude of audio signals (e.g. from an entertainment device, e.g. a TV or a music player, a telephone apparatus, e.g. a mobile telephone or a computer, e.g. a PC) and adapted for selecting and/or combining an appropriate one of the received audio signals (or combination of signals) for transmission to the hearing device.

In an embodiment, the auxiliary device is or comprises another hearing device. In an embodiment, the hearing system comprises two hearing devices adapted to implement a binaural hearing system, e.g. a binaural hearing aid system.

An APP:

In a further aspect, a non-transitory application, termed an APP, is furthermore provided by the present disclosure. The APP comprises executable instructions configured to be executed on an auxiliary device to implement a user interface for a hearing device or a hearing system described above in the 'detailed description of embodiments', and in the claims. In an embodiment, the APP is configured to run on cellular phone, e.g. a smartphone, or on another portable device allowing communication with said hearing device or said hearing system.

Definitions

The 'near-field' of an acoustic source is a region close to the source where the sound pressure and acoustic particle velocity are not in phase (wave fronts are not parallel). In the near-field, acoustic intensity can vary greatly with distance (compared to the far-field). The near-field is generally taken to be limited to a distance from the source equal to about one or two wavelengths of sound. The wavelength $\lambda$ of sound is given by $\lambda=c/f$, where c is the speed of sound in air (343 m/s, @ 20° C.) and f is frequency. At f=1 kHz, e.g., the wavelength of sound is 0.343 m (i.e. 34 cm). In the acoustic 'far-field', on the other hand, wave fronts are parallel and the sound field intensity decreases by 6 dB each time the distance from the source is doubled (inverse square law).

In the present context, a 'hearing device' refers to a device, such as a hearing aid, e.g. a hearing instrument, or an active ear-protection device, or other audio processing device, which is adapted to improve, augment and/or protect the hearing capability of a user by receiving acoustic signals from the user's surroundings, generating corresponding audio signals, possibly modifying the audio signals and providing the possibly modified audio signals as audible signals to at least one of the user's ears. A 'hearing device' further refers to a device such as an earphone or a headset adapted to receive audio signals electronically, possibly modifying the audio signals and providing the possibly modified audio signals as audible signals to at least one of the user's ears. Such audible signals may e.g. be provided in the form of acoustic signals radiated into the user's outer ears, acoustic signals transferred as mechanical vibrations to the user's inner ears through the bone structure of the user's head and/or through parts of the middle ear as well as electric signals transferred directly or indirectly to the cochlear nerve of the user.

The hearing device may be configured to be worn in any known way, e.g. as a unit arranged behind the ear with a tube leading radiated acoustic signals into the ear canal or with an output transducer, e.g. a loudspeaker, arranged close to or in the ear canal, as a unit entirely or partly arranged in the pinna and/or in the ear canal, as a unit, e.g. a vibrator, attached to a fixture implanted into the skull bone, as an attachable, or entirely or partly implanted, unit, etc. The hearing device may comprise a single unit or several units communicating electronically with each other. The loudspeaker may be arranged in a housing together with other components of the hearing device, or may be an external unit in itself (possibly in combination with a flexible guiding element, e.g. a dome-like element).

More generally, a hearing device comprises an input transducer for receiving an acoustic signal from a user's surroundings and providing a corresponding input audio signal and/or a receiver for electronically (i.e. wired or wirelessly) receiving an input audio signal, a (typically configurable) signal processing circuit (e.g. a signal processor, e.g. comprising a configurable (programmable) processor, e.g. a digital signal processor) for processing the input audio signal and an output unit for providing an audible signal to the user in dependence on the processed audio signal. The signal processor may be adapted to process the input signal in the time domain or in a number of frequency bands. In some hearing devices, an amplifier and/or compressor may constitute the signal processing circuit. The signal processing circuit typically comprises one or more (integrated or separate) memory elements for executing programs and/or for storing parameters used (or potentially used) in the processing and/or for storing information relevant for the function of the hearing device and/or for storing information (e.g. processed information, e.g. provided by the signal processing circuit), e.g. for use in connection with an interface to a user and/or an interface to a programming device. In some hearing devices, the output unit may comprise an output transducer, such as e.g. a loudspeaker for providing an air-borne acoustic signal or a vibrator for providing a structure-borne or liquid-borne acoustic signal. In some hearing devices, the output unit may comprise one or more output electrodes for providing electric signals (e.g. a multi-electrode array for electrically stimulating the cochlear nerve). In an embodiment, the hearing device comprises a speakerphone (comprising a number of input transducers and a number of output transducers, e.g. for use in an audio conference situation).

In some hearing devices, the vibrator may be adapted to provide a structure-borne acoustic signal transcutaneously or percutaneously to the skull bone. In some hearing devices, the vibrator may be implanted in the middle ear and/or in the inner ear. In some hearing devices, the vibrator may be adapted to provide a structure-borne acoustic signal to a middle-ear bone and/or to the cochlea. In some hearing devices, the vibrator may be adapted to provide a liquid-borne acoustic signal to the cochlear liquid, e.g. through the oval window. In some hearing devices, the output electrodes may be implanted in the cochlea or on the inside of the skull bone and may be adapted to provide the electric signals to the hair cells of the cochlea, to one or more hearing nerves, to the auditory brainstem, to the auditory midbrain, to the auditory cortex and/or to other parts of the cerebral cortex.

A hearing device, e.g. a hearing aid, may be adapted to a particular user's needs, e.g. a hearing impairment. A configurable signal processing circuit of the hearing device may be adapted to apply a frequency and level dependent compressive amplification of an input signal. A customized frequency and level dependent gain (amplification or compression) may be determined in a fitting process by a fitting system based on a user's hearing data, e.g. an audiogram, using a fitting rationale (e.g. adapted to speech). The frequency and level dependent gain may e.g. be embodied in processing parameters, e.g. uploaded to the hearing device via an interface to a programming device (fitting system), and used by a processing algorithm executed by the configurable signal processing circuit of the hearing device.

A 'hearing system' refers to a system comprising one or two hearing devices, and a 'binaural hearing system' refers to a system comprising two hearing devices and being adapted to cooperatively provide audible signals to both of the user's ears. Hearing systems or binaural hearing systems may further comprise one or more 'auxiliary devices', which communicate with the hearing device(s) and affect and/or benefit from the function of the hearing device(s). Auxiliary devices may be e.g. remote controls, audio gateway devices, mobile phones (e.g. smartphones), or music players. Hearing devices, hearing systems or binaural hearing systems may e.g. be used for compensating for a hearing-impaired person's loss of hearing capability, augmenting or protecting a normal-hearing person's hearing capability and/or conveying electronic audio signals to a person. Hearing devices or hearing systems may e.g. form part of or interact with public-address systems, active ear protection systems, handsfree telephone systems, car audio systems, entertainment (e.g. karaoke) systems, teleconferencing systems, classroom amplification systems, etc.

Embodiments of the disclosure may e.g. be useful in applications such as hearing aids.

BRIEF DESCRIPTION OF DRAWINGS

The aspects of the disclosure may be best understood from the following detailed description taken in conjunction with the accompanying figures. The figures are schematic and simplified for clarity, and they just show details to improve the understanding of the claims, while other details are left out. Throughout, the same reference numerals are used for identical or corresponding parts. The individual features of each aspect may each be combined with any or all features of the other aspects. These and other aspects, features and/or technical effect will be apparent from and elucidated with reference to the illustrations described hereinafter in which:

The figures are schematic and simplified for clarity, and they just show details which are essential to the understanding of the disclosure, while other details are left out. Throughout, the same reference signs are used for identical or corresponding parts.

Further scope of applicability of the present disclosure will become apparent from the detailed description given hereinafter. However, it should be understood that the detailed description and specific examples, while indicating preferred embodiments of the disclosure, are given by way of illustration only. Other embodiments may become apparent to those skilled in the art from the following detailed description.

DETAILED DESCRIPTION OF EMBODIMENTS

The detailed description set forth below in connection with the appended drawings is intended as a description of various configurations. The detailed description includes specific details for the purpose of providing a thorough understanding of various concepts. However, it will be apparent to those skilled in the art that these concepts may be practiced without these specific details. Several aspects of the apparatus and methods are described by various blocks, functional units, modules, components, circuits, steps, processes, algorithms, etc. (collectively referred to as "elements"). Depending upon particular application, design constraints or other reasons, these elements may be implemented using electronic hardware, computer program, or any combination thereof.

The electronic hardware may include microprocessors, microcontrollers, digital signal processors (DSPs), field programmable gate arrays (FPGAs), programmable logic devices (PLDs), gated logic, discrete hardware circuits, and other suitable hardware configured to perform the various functionality described throughout this disclosure. Computer program shall be construed broadly to mean instructions, instruction sets, code, code segments, program code, programs, subprograms, software modules, applications, software applications, software packages, routines, subroutines, objects, executables, threads of execution, procedures, functions, etc., whether referred to as software, firmware, middleware, microcode, hardware description language, or otherwise.

The present application relates to the field of hearing devices, e.g. hearing aids, in particular to feedback management.

In the present application, a spatial feedback system that cancels or attenuates the acoustical feedback from the vent or an acoustical leakage between the ear mould and the ear canal wall is disclosed. The spatial anti feedback is achieved by using the two microphones already present in a conventional directional ITE style HI. The conventional use of the two microphones is to spatially filter the external sounds from the environment in order to separate acoustical noise from wanted acoustical signals usually from the frontal direction. This spatial filtering is in this invention also used to attenuate the feedback from the vent or leakage without attenuating the wanted external acoustical sound signal. This is here termed spatial anti feedback.

Figure 1A:
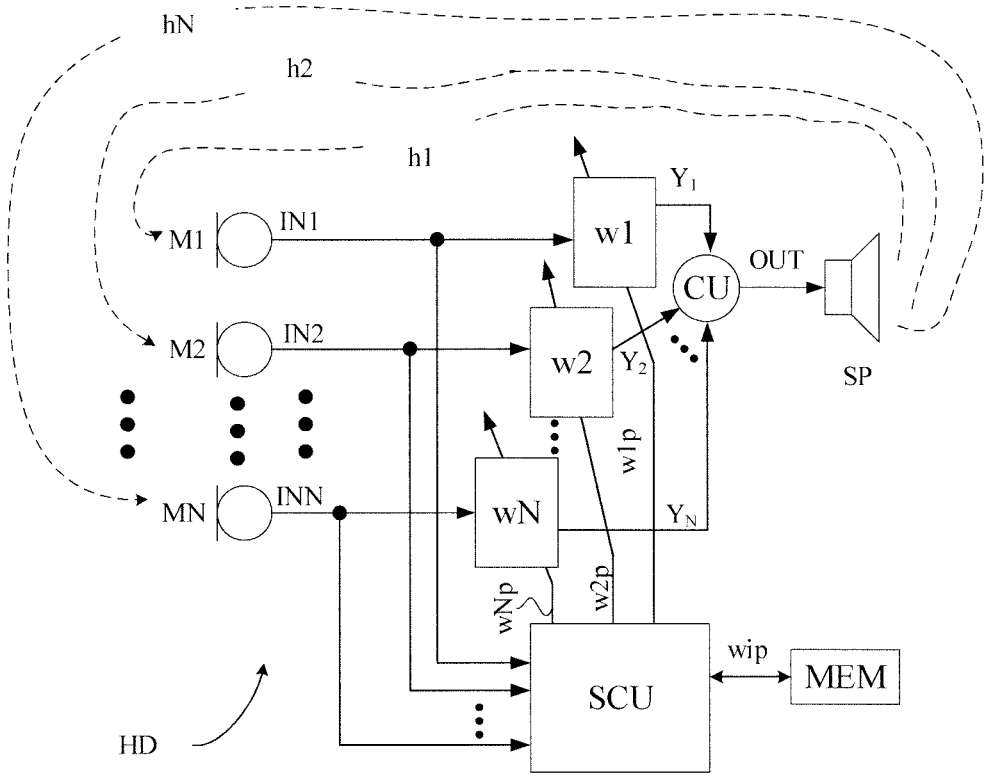
FIG. 1A shows a first embodiment of a hearing device comprising a directional system comprising a multitude of input transducers according to the present disclosure.

FIG. 1A shows an embodiment of a hearing device comprising a directional system according to the present disclosure. The hearing device (HD), e.g. a hearing aid, is configured to be located at or in an ear of a user, e.g. fully or partially in an ear canal of the user. The hearing device comprises an input unit comprising a multitude of input transducers (M1, . . . , MN) for providing respective electric input signals (IN1, IN2, . . . , INN) representing sound in an environment of the user. The hearing device further comprises an output unit comprising an output transducer (SP), here a loudspeaker, for providing stimuli perceivable to the user as sound based on said electric input signals or a processed version thereof. The hearing device further comprises a spatial filter (w1, w2, . . . , wN, CU) connected to the input unit and to the output unit, and configured to provide a spatially filtered signal (OUT) based on the multitude of electric input signals and configurable beamformer weights (w1*p*, w2*p*, . . . , wNp, where p is a beamformer weight set index). The spatial filter comprises weighting units (w1, w2, . . . , wN), e.g. multiplication units, each being adapted to apply respective beamformer weights (w1*p*, w2*p*, . . . , wNp) to the respective electric input signals (IN1, IN2, . . . , INN) and to provide respective weighted input signals ($Y_1$, $Y_2$, . . . , $Y_N$). The spatial filter further comprises a combination unit (CU), e.g. a summation unit, for combining the weighted input signals to one or more spatially filtered signals, here one (signal OUT), which is fed to the output transducer (SP, possibly further processed before). The hearing device (HD) further comprises a spatial filter controller (SCU) configured to apply (at least) first and/or second different sets (p=1, 2) of beamformer weights (w1*p*, w2*p*, . . . , wNp) to said multitude of electric input signals (IN1, IN2, . . . , INN). The first set of beamformer weights (p=1) is applied to provide spatial filtering of sound from the output transducer (SP) (leaking back to the input transducers, cf. dashed arrows indicating feedback paths h1, h2, . . . , hN from the output transducer (SP) to each of the N input transducers (M1, M2, . . . , MN), respectively). The second set of beamformer weights (p=2) is applied to provide spatial filtering of an external sound field (e.g. from a sound source located in the acoustic far-field relative to the hearing device, cf. FIG. 6A, 6B, 6C). The hearing device further comprises a memory (MEM) accessible from the spatial filter controller (SCU). The spatial filter controller is configured to adaptively select an appropriate set of beamformer weights (signal wip) among two or more sets (p=1, 2, . . . ) of beamformer weights stored in the memory (including the first and second sets of beamformer weights). At a given point in time, adaptive selection of an appropriate set beamformer weights may e.g. be dependent of a current input level of one or more of the multitude of input signals or of a currently requested gain from a compressor, and/or of a currently estimated loop gain.

Figure 1B:
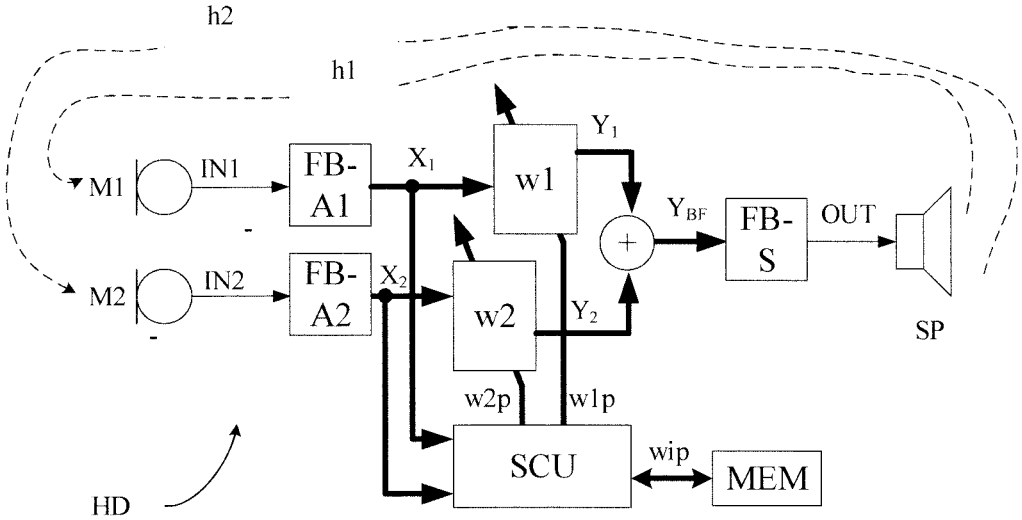
FIG. 1B a second embodiment of a hearing device comprising a directional system comprising two microphones according to the present disclosure (partly in the frequency domain)

FIG. 1B shows an embodiment of a hearing device comprising a directional system according to the present disclosure. The input unit comprises (e.g. contains only) two microphones (M1, M2) for converting sound from the environment to respective electric input signals IN1, IN2. In the embodiment of FIG. 1B, the processing of the forward path of the hearing device (from sound input to sound output) is, at least partly, conducted in the frequency domain. The input unit comprises respective filter banks (FB-A1, FB-A2) configured to provide the electric input signals (IN1, IN2) in a time-frequency representation (k,m), e.g. as digitized frequency sub-band signals ($X_1$, $X_2$), where k and m are frequency and time indices, respectively. The frequency sub-band electric input signals ($X_1$, $X_2$) are fed to the spatial filter (weighting units (w1, w2)) and to the spatial filter controller (SCU). Depending on the input signals ($X_1$, $X_2$), e.g. their level, and/or SNR, an appropriate set of beamformer filtering weights (wip) is selected at a given point in time from the memory (MEM) by the spatial filter controller (SCU) and applied to the respective weighting units (w1, w2), cf. signals w1*p*, w2*p*, thereby providing respective weighted input signals $Y_1$, $Y_2$. The weighted input signals $Y_1$, $Y_2$, are added by the SUM unit ('+') to provide spatially filtered (beamformed) signal $Y_{BF}$. The hearing device further comprises a synthesis filter bank (FB-S) for converting spatially filtered frequency sub-band signal YBF to spatially filtered time domain signal OUT, which is again fed to the loudspeaker (SP) for conversion to acoustic stimuli.

The Spatial filter controller (SCU), is configured to apply different filter weights, w1*p* and w2*p*, to the two microphone channels, in order to either do spatial anti-feedback or to do spatial filtering of the external sound field (e.g. a first set (p=1) of beamformer weights (w11, w21) for spatially filtering the sound field from the loudspeaker (SP)), and a second set (p=2) of beamformer weights (w12, w22) for spatially filtering the external sound field from sound sources in the environment around the user (not originating from the loudspeaker of the hearing device).

The acoustical feedback can be very unpredictable especially if the feedback is dominated by a leakage. It is therefore an advantage to individually calibrate the spatial anti feedback on the user's ear. This can be achieved by making an estimate of the feedback path using a conventional adaptive feedback path estimation (cf. e.g. FIG. 3) and then use the difference in the estimated feedback paths to generate a set of filter weights, w1 and w2, to achieve the spatial anti feedback. Alternatively, the filter weights could also be achieved by making an adaptive system that minimizes the output of the directional unit (output=s1*w1+s2*w2), while playing out a signal that will ensure that the input on the microphones is dominated by a feedback signal. The filter weights may alternatively or additionally be estimated from an on-line feedback path estimate.

One problem with reusing the two microphones is that it is difficult to achieve both a spatial filtering of the external sounds and on the same time do spatial anti feedback (when only two microphones are available). This invention presents two ways of solving this problem. First by making the system adaptive using the input level and second to make the system work in separate frequency bands.

A conventional HI uses dynamic range compression (compressive amplification) in order to use the limited dynamic range of the users' hearing. This means that the gain in the HI is higher at low input levels and lower at higher input levels. By making the spatial anti feedback adaptive using the input level (or a signal derived from the input level (such as e.g. the applied gain)), the system can use the spatial anti-feedback at low input levels where the gain of the instrument is higher and hence the problem with feedback is also higher. In situations with low input level there is usually not a need for spatial filtering of the external sound field.

Figure 2A:
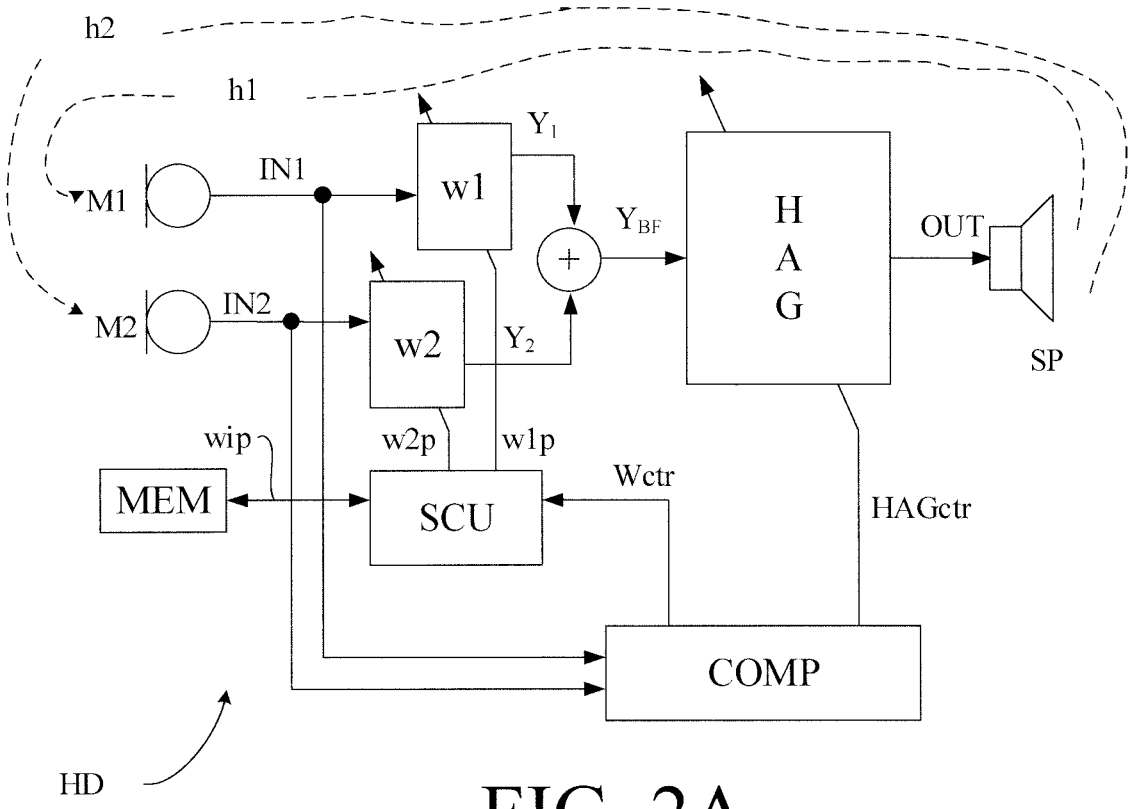
FIG. 2A shows a third embodiment of a hearing device comprising a directional system with two microphones according to the present disclosure wherein a compressor controls the gain of the system using the input levels from the microphones.

FIG. 2A shows an embodiment of a hearing device comprising a directional system with two microphones according to the present disclosure wherein a compressor controls the gain of the system using the input levels from the microphones. The embodiment of FIG. 2A is equivalent to the embodiment of FIG. 1A apart from the following differences. The embodiment of a hearing device of FIG. 2A comprises only two input transducers (microphones (M1, M2)), but additionally comprises a compressor (COMP) comprising a compressive amplification algorithm for determining an input level dependent (requested) gain in dependence of a user's needs (e.g. hearing impairment) and the current input level. Based thereon, a weight control signal Wctr is fed to the spatial filter controller (SCU), for controlling the currently selected set of beamformer weights wip, i=1, 2, p=1,2 according to a current input level of the electric input signals IN1, IN2 of the requested gain (derived from the compressive amplification algorithm adapted to the user's needs). The hearing device (HD) further comprises a processor (HAG) for further processing the spatially filtered signal $Y_{BF}$ and provide processed signal (OUT), which is fed to the output transducer (SP). The compressor (COMP) is further configured to feed gain control signal (HAGctr) to the processor (HAG) to allow the processor to apply a relevant gain to the spatially filtered signal $Y_{BF}$ (in dependence of the input level(s) or the (requested) gain derived therefrom).

Figure 2B:
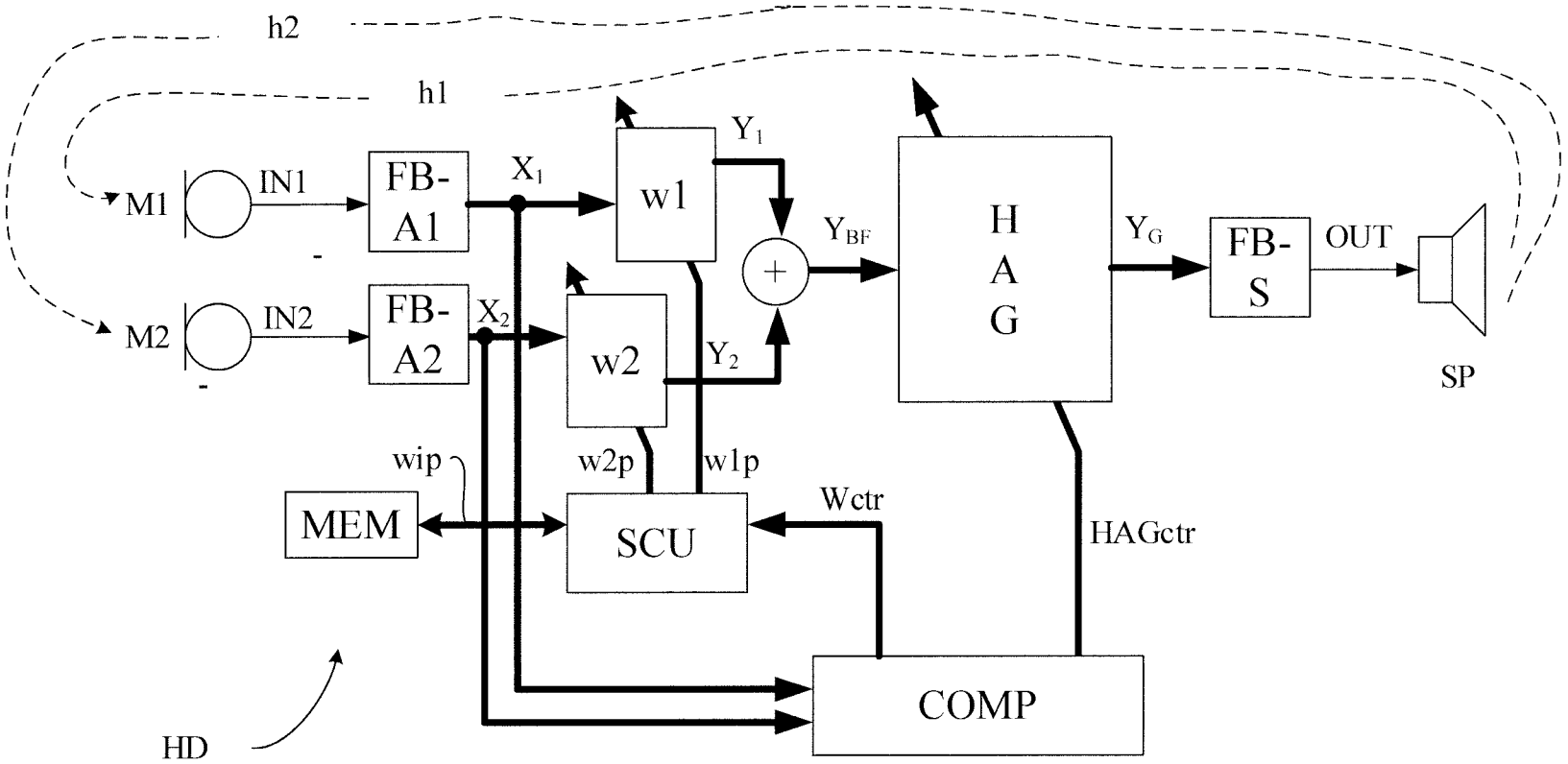
FIG. 2B shows a fourth embodiment of a hearing device comprising a directional system with two microphones according to the present disclosure wherein a compressor controls the gain of the system using the input levels from the microphones (partly in the frequency domain), FIG. 3 schematically shows a fifth embodiment of a hearing device comprising a directional system with two microphones according to the present disclosure wherein the hearing device further comprises a feedback estimation and cancellation system.

FIG. 2B shows an embodiment of a hearing device comprising a directional system with two microphones according to the present disclosure wherein a compressor controls the gain of the system using the input levels from the microphones (partly in the frequency domain).

The embodiment of FIG. 2B is equivalent to the embodiment of FIG. 2A apart from the following difference. The embodiment of a hearing device of FIG. 2B comprises appropriate analysis and synthesis filter banks (FB-A1, FB-A2, and FB-S, respectively) to allow processing of the forward path (and analysis part (SCU, COMP, MEM)) to be conducted in the frequency domain (separate processing of individual frequency sub-band signals). In the embodiment of FIG. 2B, the processor (HAG) for further processing the spatially filtered signal $Y_{BF}$ and provide processed signal $Y_G$, which is then fed to synthesis filter banks (FB-S) providing processed time domain output signal OUT, which is fed to the loudspeaker (SP).

The input level or the compression level may be used as input to the Spatial filter controller (SCU), in order to switch between spatial anti feedback (first) beamformer weights and conventional (second) directional beamformer weights.

In a situation where the input level from the external sound field is relatively high (e.g. >70 dB SPL) and where the background noise is relatively high, spatial filtering of the external sound field can be activated, and at these high input levels the compression will lower the gain, and the spatial anti-feedback system can be deactivated.

The limit for when the spatial anti-feedback can be deactivated is determined by loop gain. Spatial anti-feedback may be deactivated, when loop gain is low enough for the system to operate without the spatial anti-feedback. Typically, this is when the loop gain (loop magnitude) is lower than 0 dB, but it may depend on how well possible other anti-feedback measures in the HI are working (e.g. feedback cancellation system where an estimate of the feedback path is subtracted from an electric input signal, cf. e.g. FIG. 3).

Figure 3:
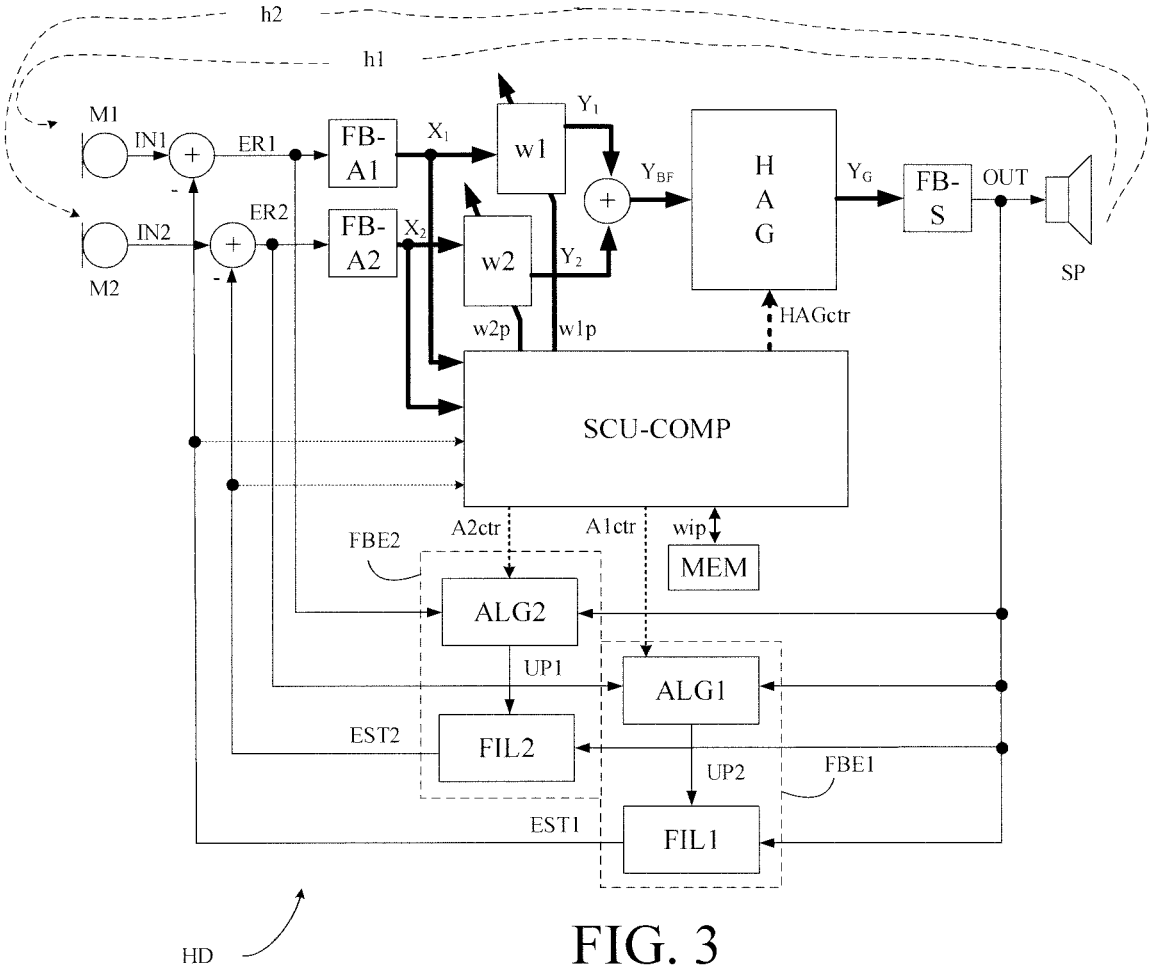

Estimates of the feedback paths from the output to the input transducers may be provided by several means, e.g. by respective adaptive filters as indicated in FIG. 3. The feedback estimates may be used in the spatial filter controller (SCU) to contribute to the decision of whether to apply the first or second set of beamformer weights at a given point in time (cf. dashed arrows in FIG. 3 feeding feedback estimates EST1, EST2 to the combined spatial filter controller and compressor (SCU-COMP)).

FIG. 3 schematically shows an embodiment of a hearing device comprising a directional system with two microphones according to the present disclosure wherein the hearing device further comprises a feedback estimation and cancellation system. The embodiment of FIG. 3 is equivalent to the embodiment of FIG. 2B apart from the following difference. The hearing device (HD) further comprises respective feedback cancellation systems for estimating and reducing feedback from the output transducer (here loudspeaker (SP)) to first and second input transducers (here microphones (M1, M2)), respectively. The first and second feedback cancellation systems comprises first and second feedback estimators (FBE1 FBE2) and subtraction units ('+') inserted in the respective microphone paths so subtract respective estimates (EST1, EST2) of the feedback paths (h1, h2) from the input signals (IN1, IN2). The subtraction units provide respective feedback corrected input signals (ER1, ER2), which are fed to the respective analysis filter banks (FB-A1, FB-A2) and to the respective feedback estimators (FBE1, FBE2). The feedback estimators (FBE1, FBE2) each comprises respective algorithm (ALG1, ALG2) and variable filter parts (FIL1, FIL2) implementing respective adaptive filters (where the algorithm parts (ALG1, ALG2) are configured to determine (and update) filter coefficients of the variable filter parts (FIL1, FIL2) via respective update signals (UP1, UP2). The adaptive filters ((ALG1, FIL1), (ALG2, FIL2)) are e.g. state of the art adaptive filters. The algorithm parts (ALG1, ALG2) may e.g. comprise Least Mean Square (LMS) or Normalized LMS (NLMS) algorithms or similar adaptive algorithms to estimate filter the coefficients (based on reference signal OUT and respective error signals (ER1, ER2)) that when applied to the variable filters for filtering the processed output (reference) signal OUT, thereby providing respective feedback estimates (EST1, EST2), minimizes the respective error signals (ER1, ER2). The feedback estimates (EST1, EST2) may be fed to the spatial filter controller (SCU, here the combined SCU-COMP-unit), for controlling the currently selected set of beamformer weights. Likewise first and second algorithm control signals (A1*ctr*, A2*ctr*) may be generated in the combined spatial filter controller and compressor (SCU-COMP) and fed to the respective feedback estimators (FBE1, FBE2), e.g. to control an adaptation rate of the adaptive algorithm, and or an update rate or time of updating the filter coefficients in the variable filter (e.g. including disabling or enabling such update of filter coefficients).

Figure 4:
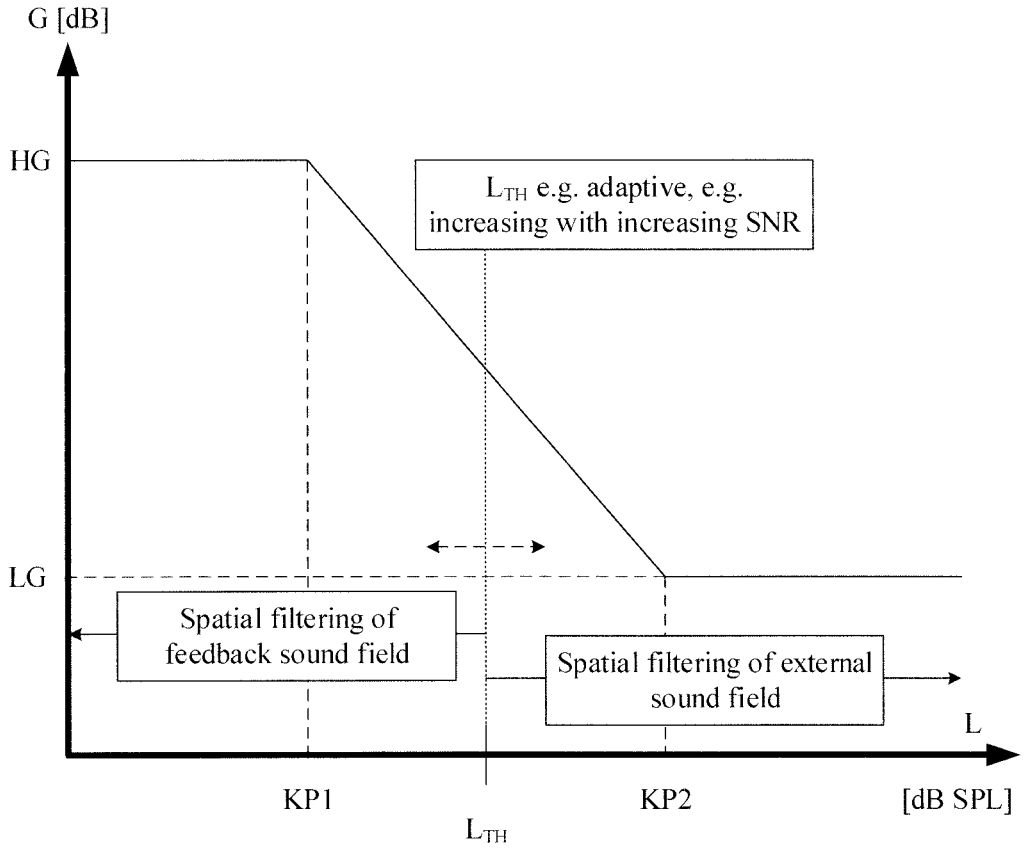
FIG. 4 shows a typical level compression curve characterized by providing relatively high gain at relatively low input levels and lower gain at higher input levels.

FIG. 4 shows a typical level compression curve (gain G [dB] versus input level L [dB SPL]) characterized by providing relatively high gain (HG) at relatively low input levels (L<KP1) and lower gain (LG) at higher input levels (L>KP2). The graph illustrates that at low input levels (e.g. $L<L_{TH}$ or <KP1) the spatial anti feedback setup of the directional system (first beamformer weights) may advantageously be used (cf. indication 'Spatial filtering of feedback sound field'), and at higher input levels (e.g. $L>L_{TH}$ or >KP2) the spatial filtering of the external sounds (second beamformer weights) may advantageously be used (cf. indication 'Spatial filtering of external sound field'). In the exemplary embodiment of FIG. 4, a threshold level $L_{TH}$ ($KP1<L_{TH}<KP2$) located between the first and second knee points forms the border between using the first and second sets of beamformer weights. The threshold level $L_{TH}$ may be predetermined. e.g. with a view to the user's hearing profile (e.g. an audiogram, and/or a level sensitivity). The threshold level $L_{TH}$ may be adaptively determined (cf. dashed double arrow denoted 'adaptive' in FIG. 4), e.g. in dependence of a current signal to noise ratio (SNR). The threshold level $L_{TH}$ may be adaptively determined, e.g. in dependence of a current signal to noise ratio (SNR) and a current requested gain (or input level). The threshold level $L_{TH}$ may increase with increasing SNR (e.g. within limits minimum and maximum values, $L_{TH,min}$ and $L_{TH,max}$, of the input level). The threshold level $L_{TH}$ may increase with increasing SNR for relatively low input levels (high gains), for input levels below a predefined threshold level.

The spatial filter controller (SCU) is configured to apply that the first and/or second different sets of beamformer weights to the multitude of electric input signals in dependence of the estimated input level(s) (or the requested gains determined therefrom by a compressive amplification algorithm). In an embodiment, the application of a given set of beamformer weights is further dependent of the current signal to noise ratio (SNR) of the electric input signal(s) or a signal derived therefrom.

If, for example, the electric input signal(s) have a relatively high SNR, and a relatively low gain (high level), there is no need for noise reduction (e.g. provided by the second beamformer weights handling signals from the acoustic far-field), so the first beamformer weights (providing spatial feedback attenuation) can advantageously be applied.

To avoid fluctuations between the two types of directional settings, hysteresis may be built into the decision. In an embodiment, for increasing levels, the switching from the first to the second beamformer weights occur when L becomes larger than KP1+ΔL1 (where ΔL1≤(KP2−KP1)), and so that for decreasing levels, the switching from the second to the first beamformer weights occur when L becomes smaller than KP2−ΔL2 (where ΔL2≤(KP2−KP1)). Alternatively fading between the two sets of beamformer weights may be introduced when input levels are between the two knee points (KP1<L<KP2).

Frequency Bands

The system described above can be designed to work in separate frequency bands, meaning for example that the spatial anti feedback is only active in frequency bands where feedback is a problem (e.g., between 1 kHz and 8 kHz, or between 1 kHz and 4 kHz). Additionally, the adaptive system described above can also be applied separately in frequency bands, meaning that the shift from spatial anti feedback to spatial filtering of the external sound field is only active in the frequency bands where the compression has lowered the gain enough for the system or work without the spatial anti feedback and/or where the spatial filtering of the external sound field is wanted. In an embodiment, only one of the first and second sets of beamformer weights is applied at a given time, in a given frequency band. In an embodiment, the first set of beamformer weights is applied in at least one frequency band, while the second set of beamformer weights is applied in another frequency band at the same time.

Figure 5:
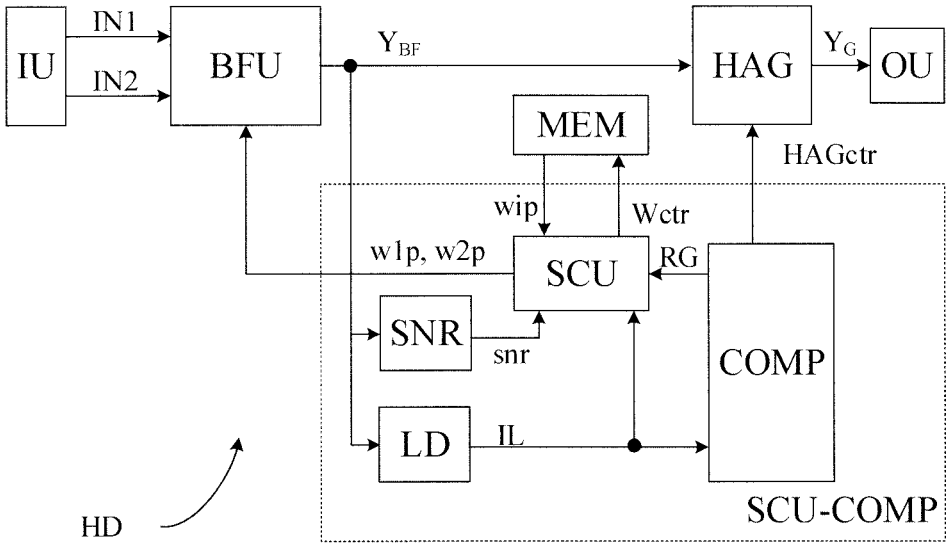
FIG. 5 shows an example of a hearing device comprising a compressor for controlling the spatial filter controller and the hearing device gain unit based on the level of the resulting weighted combination of the input signals.

FIG. 5 shows an example of a hearing device comprising a compressor (COMP) for controlling the spatial filter controller (SCU) and the hearing device gain unit (HAG) based on a level of the resulting weighted combination of the input signals (beamformed signal $Y_{BF}$). The embodiment of a hearing device (HD) of FIG. 5 is equivalent to the embodiment of FIG. 2A apart from the following differences. The embodiment of a hearing device of FIG. 5 comprises signal to noise ratio and level estimators (SNR and LD, respectively) for providing estimates of an SNR and a level of an incoming signal, here the spatially filtered (beamformed) signal $Y_{BF}$. Instead of analysing the first and second electric input signals (IN1, IN2) (as in FIG. 2A), the compressor (COMP) of the embodiment of FIG. 5 receives current estimates of the level of the beamformed signal $Y_{BF}$. Further, a current SNR (signal snr) of the spatially filtered signal $Y_{BF}$ is provided to the spatial filter controller (SCU) by the SNR estimator (SNR) together with a requested gain RG provided by the compressor (COMP) and the current estimate of the level IL of the spatially filtered signal $Y_{BF}$.

The requested gain RG is determined by the compressor (COMP) based on the input level IL of the beamformed signal YBF (as e.g. indicated in FIG. 4, e.g. individually (differently) for a given frequency band). Based thereon, the spatial filter controller (SCU) determines the appropriate set of beamformer weights (wip=w1$p$, w2$p$) (as e.g. discussed in connection with FIG. 4) and reads this set out of the memory unit (MEM) using control signal Wctr. The spatial filter controller (SCU) applies appropriate set of beamformer weights (wip=w1$p$, w2$p$) to the spatial filter (BFU).

In the embodiment of FIG. 5, levels as well as SNR are estimated based on the beamformed signal $Y_{BF}$. One or both parameters (level and SNR) can be estimated in various ways, e.g. based on one or more of the electric input signals (IN1, IN2).

In an embodiment, level and SNR are estimated directly from the electric input signals (IN1, IN2). This may be advantageous, because level and SNR may change if the beamformer changes.

Figure 6A:
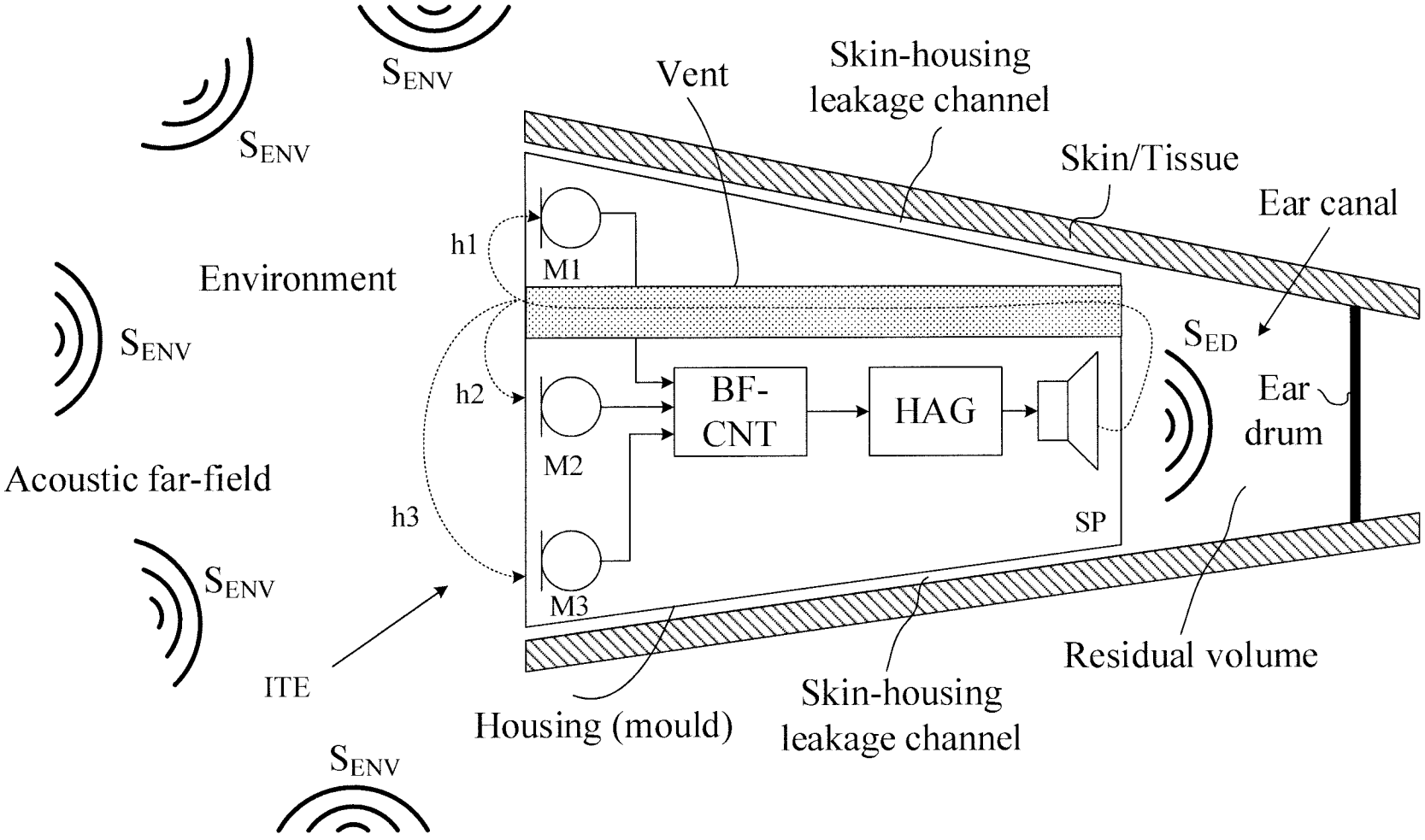
FIG. 6A shows a first embodiment of a hearing device comprising three microphones located in an ITE part adapted for being located at or in an ear canal of the user.

FIG. 6A shows an embodiment of a hearing device comprising an ITE part adapted (ITE) for being located at or in an ear canal (Ear canal) of the user. The ITE part may e.g. constitute the hearing device, or it may form part of a hearing device further comprising one or more portable parts, e.g. including a BTE part configured to be worn at or behind the ear (pinna), and operationally connected to the ITE-part via an acoustic or electric or electromagnetic (e.g. optic) connection. The ITE-part comprises a housing (Housing (mould) in FIG. 6A), which may be customized to a particular user's physiognomy (ear, and/or ear canal) or it may be a standard part ('one-size-fits-all') intended to be used by a group of customers.

The ITE-part (ITE) comprises a vent channel (or a number of vent channels), in FIG. 6A indicated by a single through-going straight opening (Vent). The vent channel may take on different forms, be it in cross-section of longitudinal extension through the housing of the ITE-part. It may further be distributed on a number of separate venting channels, one or more of which may be formed as through going openings or as indentations in the surface of the housing (forming a channel with a wall (Skin/Tissue) of the ear canal), cf. also Skin-housing leakage channel in FIG. 6A (which may be intentional or un-intentional).

The hearing device (here the ITE-part) comprises three input transducers (here microphones M1, M2, M3, providing respective (e.g. digitized) electrical input signals (possibly as frequency sub-band signals) electrically connected to spatial filter and controller (BF-CNT) providing a spatially filtered (beamformed) signal (e.g. $Y_{BF}$ in FIG. 5) to a processor (HAG) for applying an appropriate gain according to a user's needs in dependence of the acoustic environment (Environment), as reflected by sound filed $S_{ENV}$ and electric input signals picked up by the microphones), and providing a processed signal (e.g. $Y_G$ in FIG. 5). The processed signal is fed to an output transducer (here a loudspeaker (SP)) and presented to the user as audible signals (here via sound field $S_{ED}$ crating vibrations of air in the residual volume (Residual volume) in the ear canal (Ear canal) between the housing of the ITE-part and the ear drum (Ear drum). The spatial filter and controller (BF-CNT) is configured to apply an appropriate set of beamformer weights to the three electric input signals and provide a corresponding spatially filtered signal as proposed by the present disclosure. The set of beamformer weights is selected in dependence of the input level and or requested gain (and thus hearing profile of the user) and possibly other properties of the input signals (e.g. a target signal to noise ratio).

The hearing device may comprise fewer ore more input transducers (e.g. microphones) than three. Some of the microphones may be located in other parts of the hearing device (possibly in concha or elsewhere at or around an ear of the user (e.g. in a BTE part adapted be being arranged at or behind pinna). In an embodiment, one of the microphones is located on or close to the a part of the surface of the ITE part facing the residual volume and ear drum, e.g. to measure or monitor the sound field in the residual volume (e.g. for active noise cancellation, etc.).

The three microphones of the embodiment of FIG. 6A are shown to be located on/or close to a part of the surface of the ITE part facing the environment (opposite the residual volume and ear drum), e.g. mounted on a faceplate of an ear mould. In an embodiment, at least one of the microphones is located along a longitudinal axis of the hearing device in a direction towards the ear drum (to create a microphone axis towards the eardrum). Thereby spatial separation of sound from the outside (environment) and from the inside (residual volume) is facilitated, including spatial filtering of sound from the output transducer (loudspeaker (SP). Such embodiments are shown in FIG. 6B, 6C.

Figure 6B:
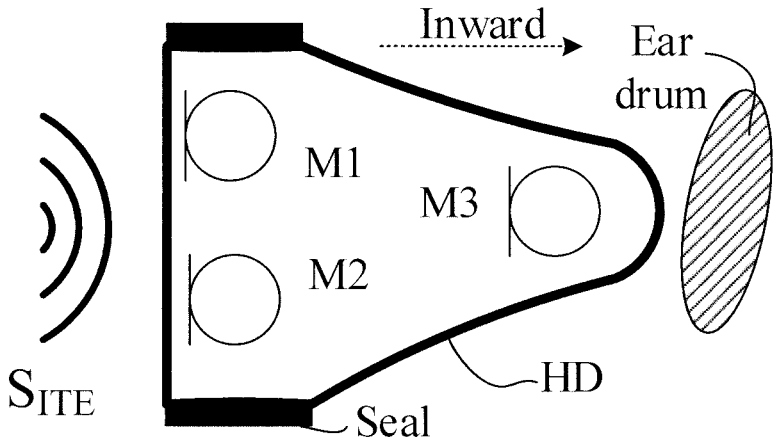
FIG. 6B shows a second embodiment of a hearing device comprising three microphones located in an ITE-part adapted for being located at or in an ear canal of the user.

FIG. 6B shows an embodiment of a hearing device according to the present disclosure comprising three microphones located in an ITE-part adapted for being located at or in an ear canal of the user. The embodiment of a hearing device (HD) of FIG. 6B comprises three microphones (M1, M2, M3) in an ITE-part. Two of the microphones (M1, M2) face the environment, and one microphone (M3) faces the ear drum (when the hearing device is operationally mounted). The hearing device comprises, or is constituted by, the ITE-part. The ITE-part may comprise a sealing element for providing a tight seal (cf. 'seal' in FIG. 6B) towards the walls of the ear canal to acoustically 'isolate' the ear drum facing microphone (M3) from the environment sound ($S_{ITE}$) impinging on the ear canal (and hearing device), cf. FIG. 6B. In an embodiment, the fitting is more open to allow environment sound to reach the microphone (M3) facing the ear drum. The hearing device (HD) may comprise the same functional elements as the embodiments of FIG. 1A, 1B, 2A, 2B, 3, 5, 6A, 7A.

Figure 6C:
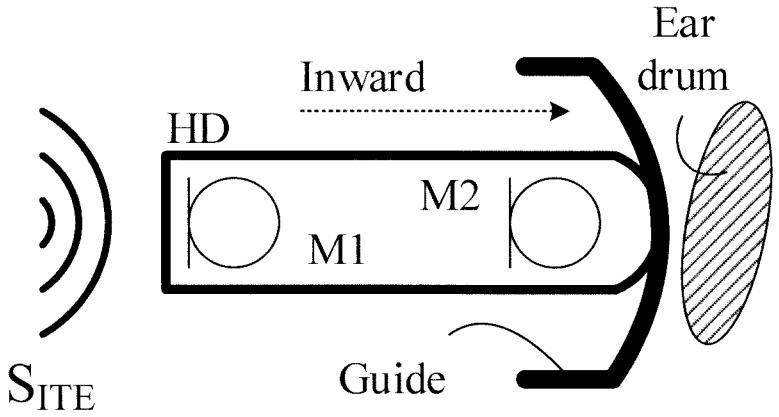
FIG. 6C shows an embodiment of a hearing device comprising two microphones located in an ITE-part adapted for being located at or in an ear canal of the user.

FIG. 6C shows an embodiment of a hearing device (HD), e.g. a hearing aid, comprising two microphones (M1, M2) located in an ITE-part according to the present disclosure. The ITE-part comprises a housing, wherein the two ITE-microphones are located (e.g. in a longitudinal direction of the housing along an axis of the ear canal (cf. dotted arrow 'Inward' in FIG. 6C), when the hearing device (HD) is operationally mounted on or at the user's ear. The ITE-part further comprises a guiding element ('Guide' in FIG. 6C) configured to guide the ITE-part in the ear canal during mounting and use of the hearing device (HD) without fully blocking the ear canal (to avoid occlusion, and to allow environment sound (from sound field $S_{ITE}$) to reach the microphone (M2) closest to the ear drum.). The ITE-part further comprises a loudspeaker (facing the ear drum) for playing a resulting audio signal to the user, whereby a sound field is generated in the residual volume. A fraction thereof is leaked back towards the ITE-microphones (M1, M2) and the environment. The hearing device (e.g. the ITE-part) may constitute a part customized to the ear or the user, e.g. in form, or alternatively have a standardized form. The hearing device (HD) may comprise the same functional elements as the embodiments of FIG. 1A, 1B, 2A, 2B, 3, 5, 6A, 7A, 7B.

Figure 7A:
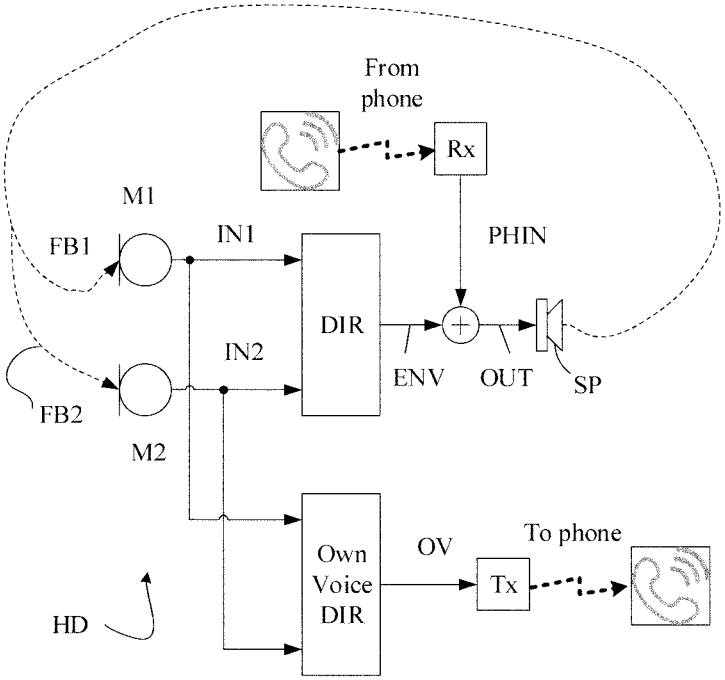
FIG. 7A shows a first exemplary telephone mode use case of a hearing device according to the present disclosure.
Figure 7B:
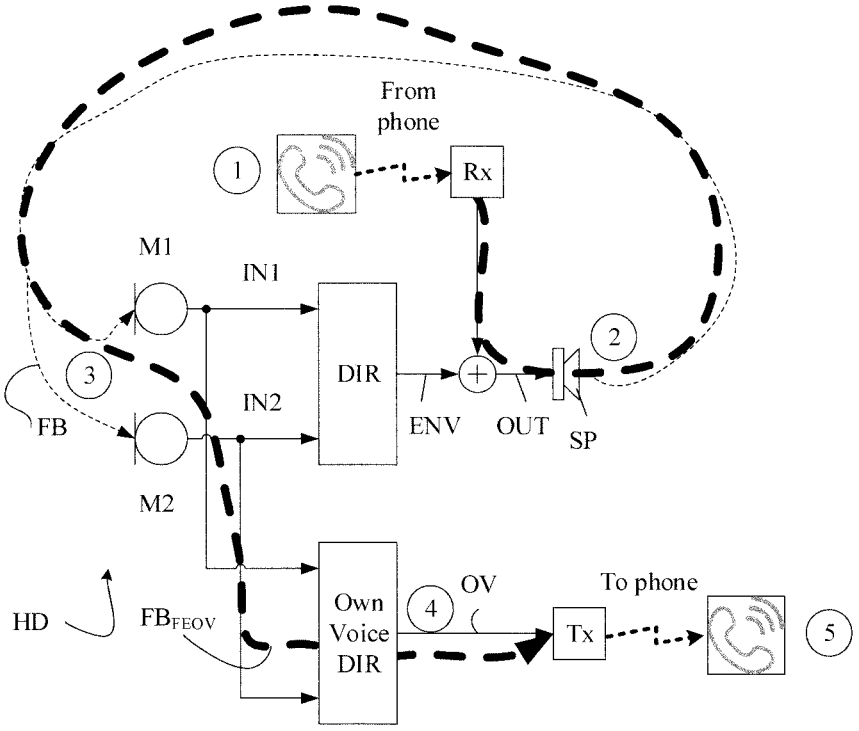
FIG. 7B shows a second exemplary telephone mode use case of a hearing device according to the present disclosure.

FIGS. 7A and 7B illustrates an exemplary telephone mode of a hearing device (HD) according to the present disclosure. In this application, we may both aim at spatially reducing feedback in the beamformer signal presented locally and the beamformer signal presented to the far-end speaker of a telephone conversation.

FIG. 7A shows an embodiment of a hearing device (HD) comprising two microphones (M1, M2) to provide electric input signals IN1, IN2 representing sound in the environment of a user wearing the hearing device. The hearing device further comprises spatial filters DIR and Own Voice DIR, each providing a spatially filtered signal (ENV and OV respectively) based on the electric input signals. The spatial filter DIR may e.g. implement a first, feedback cancelling, and/or second, target maintaining, noise cancelling, beamformer according to the present disclosure. The spatial filter Own Voice DIR is a spatial filter according to the present disclosure. The spatial filter Own Voice DIR implements a first, feedback cancelling, and/or a second, own voice, beamformer directed at the mouth of the user (its activation being e.g. controlled by an own voice presence control signal, and/or a telephone mode control signal, and/or a far-end talker presence control signal). In a specific telephone mode of operation, the user's own voice is picked up by the microphones M1, M2 and spatially filtered by the own voice beamformer of spatial filter Own Voice DIR providing signal OV, which is fed to transmitter Tx and transmitted (by cable or wireless link to a telephone (cf. dashed arrow denoted 'To phone' and telephone symbol). In the specific telephone mode of operation, signal PHIN is received by (wired or wireless) receiver Rx from a telephone (as indicated by telephone symbol and dashed arrow denoted 'From Phone'). When a far-end talker is active, signal PHIN contains speech from the fare-end talker, e.g. transmitted via a telephone line (e.g. fully or partially wirelessly, but typically at least partially cable-borne). The 'far-end' telephone signal PHIN is mixed with the environment signal ENV from the spatial filter DIR in combination unit (here sum unit) '+', and the mixed signal OUT is fed to output transducer SP (e.g. a loudspeaker or a vibrator of a bone conduction hearing device) for presentation to the user as sound.

FIG. 7B is identical to FIG. 7A except that the feedback path during activation of the own voice beamformer during a telephone conversation is indicated in FIG. 7B (in bold dashed line denoted $FB_{FEOV}$).

At the own voice beamformer (provided by the Own Voice DIR unit), we do not have feedback (like a closed form loop), but we may have an echo problem as part of the external signal that is picked up by the own voice beamformer, and transmitted back to the far-end talker. This may be the case when the far-end talker is active (cf. encircled digit '1' in FIG. 7B), in which case the voice of the far-end talker is played by the loudspeaker (SP) of the hearing device (HD) (cf. encircled digit '2'). Via feedback paths FB1, FB2 (commonly denoted FB in FIG. 7B) the voice of the far-end talker is picked up by the microphones (M1, M2) (cf. encircled digit '3'). The two electric input signals are combined in the Own Voice DIR unit (in a normal own voice mode of operation) to own voice signal OV (cf. encircled digit '4'). The 'own voice signal' OV may not contain the hearing device user's voice, because he or she will probably be silent, when the far-end talker is active. The 'own voice signal' OV may, on the other hand, contain a certain fraction of the far-end talker's voice. If the latter is the case, the far-end talker's voice eventually reaches the far-end talker (again) after transmission (by transmitter Tx, e.g. via a local telephone and a PSTN) to 'the other end' (cf. encircled digit '5') as an un-desired echo. In that case too, it would be desirable to fade between an own voice beamformer adapted to cancel noise from the surroundings (when the hearing device user is talking) and a feedback cancelling beamformer (when the far-end user is talking) (far-end echo illustrated by the dashed bold line denoted $FB_{FEOV}$ and encircled digits 1-5).

Switching (fading) between the first (feedback cancelling) beamformer and the second (own voice, environment noise reducing) beamformer (of the Own Voice DIR) may e.g. be controlled by a voice detector capable of detecting the own voice of the user of the hearing device together with a mode control signal indicating whether or not the hearing device is in a telephone mode of operation. If this is the case, a switching (or fading) of the Own Voice DIR unit between the (second) own voice beamformer and the (first) feedback cancelling beamformer may be made in dependence of whether or not the own voice detector detects the own voice of the user of the hearing device (assuming that the user and the far-end talker are not (generally) talking at the same time). In an embodiment, the hearing device comprises a separate voice detector coupled to the receiver (Rx) to decide on whether the signal from the far-end contains speech (or any other detector indicating voice activity of a far-end talker). This speech detector may then (alternatively) be used to switch between the two beamformers of the Own Voice DIR unit (under the same assumption of non-simultaneous speaking). The hearing device may contain an own voice detector (e.g. connected to one of the electric input signals (IN1, IN2), or the own voice signal OV) as well as a speech detector (e.g. connected to the receiver Rx or the combination unit '+' based on the output signal (OUT)) to detect far-end speech, and let the combined result of the two detectors control the switching between the two beamformers.

Figure 8:
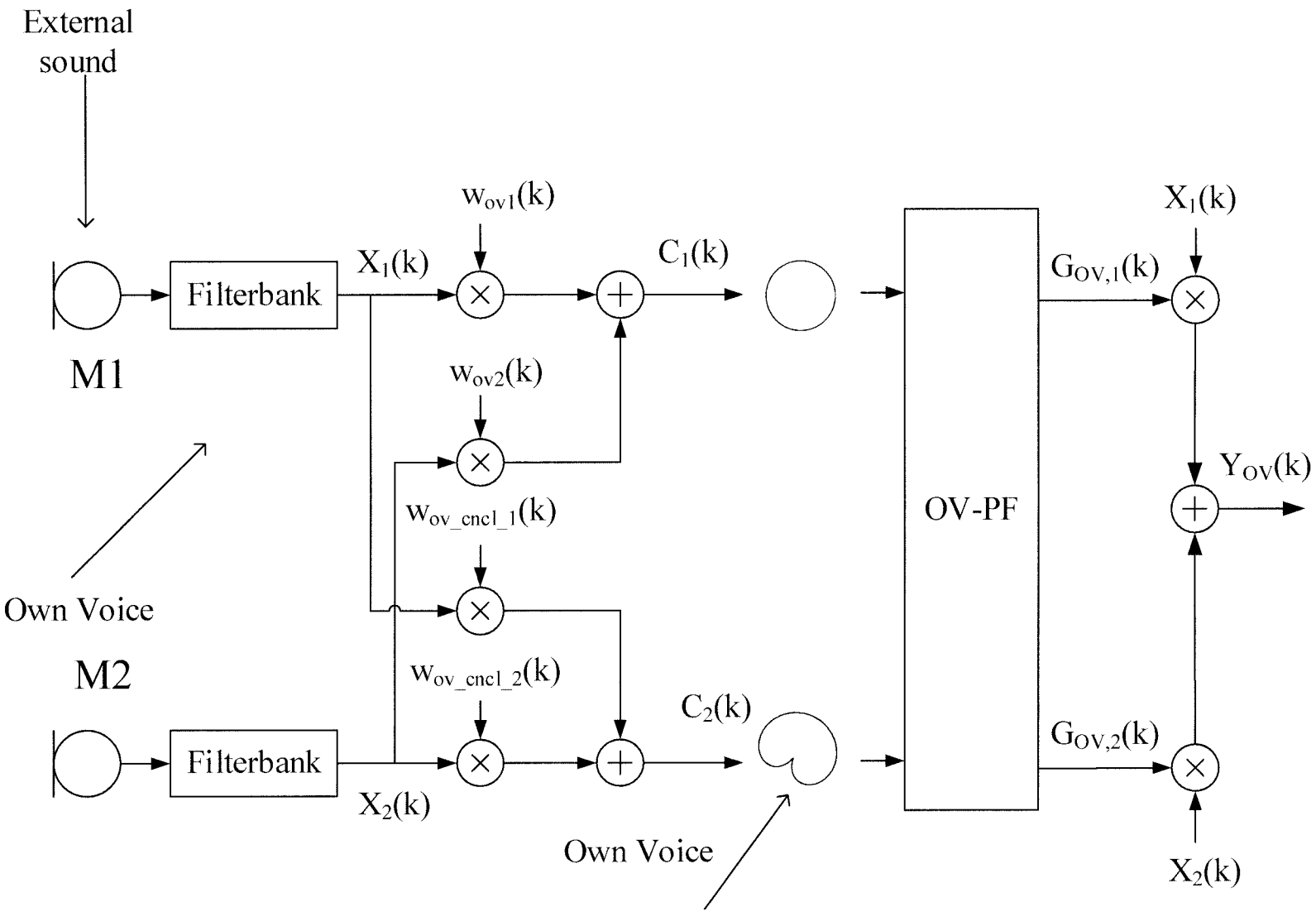
FIG. 8 shows an embodiment of an own voice beamformer, e.g. for the telephone mode illustrated in FIG. 7A, 7B.

FIG. 8 shows an embodiment of an own voice beamformer, e.g. for the telephone mode illustrated in FIG. 7A, 7B, implemented using the configuration comprising two microphones. FIG. 8 shows an own voice beamformer according to the present disclosure illustrating how the own voice-enhancing post filter (OV-PF) gains ($G_{OV,1}(k)$ and $G_{OV,2}(k)$ of FIG. 8B) may be estimated. The own voice gains are determined on the basis of a current noise estimate, here provided by a combination of an own voice cancelling beamformer ($C_2(k)$), defined by (frequency dependent, cf. frequency index k) complex beamformer weights ($w_{ov_encl_1}(k)$, $w_{ov_encl_2}(k)$) and another beamformer ($C_1(k)$, here an omni-directional beamformer), defined by complex beamformer weights ($w_{ov,1}(k)$, $w_{ov,2}(k)$) containing the own voice signal. In an embodiment, the own voice enhancing beamformer is adaptive. A direction from the user's mouth, when the hearing device is operationally mounted is schematically indicated (cf. solid arrow denoted 'Own Voice' in FIG. 8). Correspondingly, a direction from an external sound source is schematically indicated in FIG. 8 shows a (possibly adaptive) beamformer configuration, wherein post filter gains (PF gain), $G_{OV,1}(k)$ and $G_{OV,2}(k)$, are determined (cf. output of OV-PF-block) and applied to respective input signals $X_1(k)$ and $X_2(k)$ in respective multiplication units ('X'). The resulting signals ($G_{OV,1}(k)$ $X_1(k)$ and $G_{OV,2}(k)$ $X_2(k)$, respectively) are added in sum unit ('+') to provide the own voice estimate $Y_{OV}(k)$. The own voice estimate ($Y_{BF}$, OV in FIG. 7A, 7B) may (e.g. an own-voice mode of operation, e.g. when a connection to a telephone or other remote device is established (cf. e.g. FIG. 7A, 7B)) be transmitted to a remote device via a transmitter (cf. e.g. Tx in FIG. 7A, 7B), (e.g. to a far-end listener of a telephone, cf. FIG. 7A, 7B). In the 'own voice mode', noise from external sound sources may be reduced by the beamformer.

A binaural hearing system comprising first and second hearing devices (e.g. hearing aids) as described above may be provided. The first and second hearing devices may be configured to allow the exchange of data, e.g. audio data, and with another device, e.g. a telephone, or a speakerphone, a computer (e.g. a PC or a tablet). Own voice estimation may be provided based on signals from microphones in the first and second hearing devices. Own voice detection may be provided in both hearing devices. A final own voice detection decision may be based on own voice detection values from both hearing devices or based on signals from microphones in the first and second hearing devices.

It is intended that the structural features of the devices described above, either in the detailed description and/or in the claims, may be combined with steps of the method, when appropriately substituted by a corresponding process.

As used, the singular forms "a," "an," and "the" are intended to include the plural forms as well (i.e. to have the meaning "at least one"), unless expressly stated otherwise. It will be further understood that the terms "includes," "comprises," "including," and/or "comprising," when used in this specification, specify the presence of stated features, integers, steps, operations, elements, and/or components, but do not preclude the presence or addition of one or more other features, integers, steps, operations, elements, components, and/or groups thereof. It will also be understood that when an element is referred to as being "connected" or "coupled" to another element, it can be directly connected or coupled to the other element but an intervening element may also be present, unless expressly stated otherwise. Furthermore, "connected" or "coupled" as used herein may include wirelessly connected or coupled. As used herein, the term "and/or" includes any and all combinations of one or more of the associated listed items. The steps of any disclosed method is not limited to the exact order stated herein, unless expressly stated otherwise.

It should be appreciated that reference throughout this specification to "one embodiment" or "an embodiment" or "an aspect" or features included as "may" means that a particular feature, structure or characteristic described in connection with the embodiment is included in at least one embodiment of the disclosure. Furthermore, the particular features, structures or characteristics may be combined as suitable in one or more embodiments of the disclosure. The previous description is provided to enable any person skilled in the art to practice the various aspects described herein. Various modifications to these aspects will be readily apparent to those skilled in the art, and the generic principles defined herein may be applied to other aspects.

The claims are not intended to be limited to the aspects shown herein, but is to be accorded the full scope consistent with the language of the claims, wherein reference to an element in the singular is not intended to mean "one and only one" unless specifically so stated, but rather "one or more." Unless specifically stated otherwise, the term "some" refers to one or more.

Accordingly, the scope should be judged in terms of the claims that follow.

REFERENCES

EP3267697A1 (Oticon) 10 Jan. 2018

The invention claimed is:

1. A hearing device (HD) configured to be located at or in an ear of a user, the hearing device comprising an input unit (IU) comprising a multitude of input transducers (M1, M2) for providing respective electric input signals (IN1, IN2) representing sound in an environment of the user;

an output unit (OU) comprising an output transducer (SP) for providing stimuli perceivable to the user as sound based on said electric input signals (IN1, IN2) or a processed version thereof;

a spatial filter (BFU) connected to said input unit (IU) and to said output unit (OU), and configured to provide a spatially filtered signal ($Y_{BF}$) based on said multitude of electric input signals (IN1, IN2) and configurable beamformer weights;

a spatial filter controller (SCU) configured to apply first and/or second different sets (w1*p*, w2*p*) of beamformer weights to said multitude of electric input signals (IN1, IN2); and at least one level estimator for estimating an input level of at least one of said electric input signals, wherein the spatial filter controller (SCU) is configured to apply said first and/or second different sets of beamformer weights to said multitude of electric input signals in dependence of said estimated input level(s), wherein said first set (w1*p*) of beamformer weights is applied to provide spatial filtering of sound from said output transducer, and wherein said second set (w2*p*) of beamformer weights is applied to provide spatial filtering of an external sound field ($S_{ENV}$), and the spatial filter controller (SCU) is configured to apply the second set of beamformer weights to said multitude of electric input signals when the input level of said at least one electric input signal is higher than an input threshold level.

2. A hearing device according to claim 1 comprising an ITE part adapted for being located at least partly in an ear canal of the user.

3. A hearing device according to claim 2 wherein at least one of said input transducers is located in said ITE part.

4. A hearing device according to claim 2 wherein said output transducer is located in said ITE part.

5. A hearing device according to claim 2 wherein two of said input transducers is located in said ITE part.

6. A hearing device according to claim 1 wherein said first and second sets of beamformer weights are applied at different times.

7. A hearing device according to claim 1 containing two input transducers.

8. A hearing device according to claim 1 wherein said input unit comprises respective filter banks configured to provide said electric input signals in a time-frequency representation (k,m), where k and m are frequency and time indices, respectively.

9. A hearing device according to claim 1 configured to provide that said first and second sets of beamformer weights are frequency dependent.

10. A hearing device according to claim 1 configured to provide that said first and/or said second set of beamformer weights is/are adaptively determined.

11. A hearing device according to claim 1 configured to provide that said first and/or second sets of beamformer weights is/are only applied in selected frequency bands.

12. A hearing device according to claim 1 comprising a feedback estimator configured to provide an estimate of a current level of feedback from said output transducer to at least one of said input transducers.

13. A hearing device according to claim 1 wherein the first as well as the second set of beamformer weights are configured to maintain sound from a target direction unaltered.

14. A hearing device according to claim 1 comprising a level detector configured to provide an estimate of background noise level at a given point time.

15. A hearing device according to claim 1 being constituted by or comprising a hearing aid, a headset, an earphone, an ear protection device or a combination thereof.

16. A hearing device according to claim 1 wherein the first as well as the second set of beamformer weights are configured to maintain sound from a direction to a target sound source in the acoustic far-field unaltered.

17. A hearing device (HD) configured to be located at or in an ear of a user, the hearing device comprising an input unit (IU) comprising a multitude of input transducers (M1, M2) for providing respective electric input signals (IN1, IN2) representing sound in an environment of the user;

an output unit (OU) comprising an output transducer (SP) for providing stimuli perceivable to the user as sound based on said electric input signals (IN1, IN2) or a processed version thereof;

a spatial filter (BFU) connected to said input unit (IU) and to said output unit (OU), and configured to provide a spatially filtered signal ($Y_{BF}$) based on said multitude of electric input signals (IN1, IN2) and configurable beamformer weights;

a spatial filter controller (SCU) configured to apply first and/or second different sets (w1*p*, w2*p*) of beamformer weights to said multitude of electric input signals (IN1, IN2), wherein said first set (w1*p*) of beamformer weights is applied to provide spatial filtering of sound from said output transducer, and wherein said second set (w2*p*) of beamformer weights is applied to provide spatial filtering of an external sound field ($S_{ENV}$); and a compressor providing a current requested gain to be applied to one of said electric input signals or to a weighted combination of said electric input signals in dependence of A) a level estimate of the electric input signal in question and B) of a user's needs, wherein the spatial filter controller (SCU) is configured to apply said first and/or second different sets of beamformer weights to said multitude of electric input signals in dependence of said current requested gain.

18. A hearing device according to claim 17 wherein the spatial filter controller (SCU) is configured to apply the first set of beamformer weights to said multitude of electric input signals when the current requested gain is higher than a threshold gain.

19. A hearing device (HD) configured to be located at or in an ear of a user, the hearing device comprising an input unit (IU) comprising a multitude of input transducers (M1, M2) for providing respective electric input signals (IN1, IN2) representing sound in an environment of the user;

an output unit (OU) comprising an output transducer (SP) for providing stimuli perceivable to the user as sound based on said electric input signals (IN1, IN2) or a processed version thereof;

a spatial filter (BFU) connected to said input unit (IU) and to said output unit (OU), and configured to provide a spatially filtered signal ($Y_{BF}$) based on said multitude of electric input signals (IN1, IN2) and configurable beamformer weights;

a spatial filter controller (SCU) configured to apply first and/or second different sets (w1*p*, w2*p*) of beamformer weights to said multitude of electric input signals (IN1, IN2), wherein said first set (w1*p*) of beamformer weights is applied to provide spatial filtering of sound from said output transducer, and wherein said second set (w2*p*) of beamformer weights is applied to provide spatial filtering of an external sound field ($S_{ENV}$), and a loop gain estimator for estimating a current loop magnitude of a feedback loop defined by a forward path between the input unit and the output unit, and an external feedback path from said output unit to said input unit, and the spatial filter controller (SCU) is configured to apply said first and/or second different sets of beamformer weights to said multitude of electric input signals in dependence of said estimated current loop magnitude.

20. A hearing device according to claim 19 wherein the spatial filter controller (SCU) is configured to deactivate the first set of beamformer weights when the current loop magnitude is below a loop magnitude threshold.

21. A hearing device (HD) configured to be located at or in an ear of a user, the hearing device comprising an input unit (IU) comprising a multitude of input transducers (M1, M2) for providing respective electric input signals (IN1, IN2) representing sound in an environment of the user;

an output unit (OU) comprising an output transducer (SP) for providing stimuli perceivable to the user as sound based on said electric input signals (IN1, IN2) or a processed version thereof;

a spatial filter (BFU) connected to said input unit (IU) and to said output unit (OU), and configured to provide a spatially filtered signal ($Y_{BF}$) based on said multitude of electric input signals (IN1, IN2) and configurable beamformer weights; and a spatial filter controller (SCU) configured to apply first and/or second different sets (w1*p*, w2*p*) of beamformer weights to said multitude of electric input signals (IN1, IN2), wherein said first set (w1*p*) of beamformer weights is applied to provide spatial filtering of sound from said output transducer, and wherein said second set (w2*p*) of beamformer weights is applied to provide spatial filtering of an external sound field ($S_{ENV}$); and a level detector configured to provide an estimate of background noise level at a given point time, wherein the spatial filter controller (SCU) is configured to activate the second set of beamformer weights to said multitude of electric input signals when the current background noise level is higher than a noise threshold level and the input level is higher than an input threshold level.

* * * * *